US006960097B2

(12) United States Patent
Morishita

(10) Patent No.: US 6,960,097 B2
(45) Date of Patent: Nov. 1, 2005

(54) PRESSURE CONNECTION STRUCTURE WITH COAXIAL CABLE

(75) Inventor: Yoshimasa Morishita, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/992,013

(22) Filed: Nov. 19, 2004

(65) Prior Publication Data

US 2005/0130485 A1 Jun. 16, 2005

(30) Foreign Application Priority Data

Nov. 21, 2003 (JP) ..... 2003-393021
Dec. 3, 2003 (JP) ..... 2003-404849

(51) Int. Cl.[7] ..... H01R 11/20
(52) U.S. Cl. ..... 439/404; 439/578; 439/394
(58) Field of Search ..... 439/404, 63, 578–585, 439/675, 108, 394, 387, 393, 391, 389, 427, 439/409–410, 418, 443, 444, 607–610

(56) References Cited

U.S. PATENT DOCUMENTS 4,701,001 A * 10/1987 Verhoeven ..... 439/394
4,708,414 A * 11/1987 Lam ..... 439/394
4,743,208 A * 5/1988 Weisenburger ..... 439/398
4,767,352 A * 8/1988 Pretchel ..... 439/395
5,205,761 A * 4/1993 Nilsson ..... 439/578
5,830,015 A * 11/1998 Rodrigues et al. ..... 439/608
6,077,122 A * 6/2000 Elkhatib et al. ..... 439/608
6,746,277 B2 * 6/2004 Laub et al. ..... 439/585

FOREIGN PATENT DOCUMENTS

JP 06-196211 A 7/1994
JP 08-045577 A 2/1996
JP 10-326635 A 12/1998
JP 11-086926 A 3/1999
JP 2001-223039 A 8/2001

* cited by examiner

*Primary Examiner*—Gary Paumen
*Assistant Examiner*—Edwin A. Leon
(74) *Attorney, Agent, or Firm*—Rader, Fishman & Grauer PLLC

(57) ABSTRACT

A pressure connection structure with coaxial cables, which can reduce the number of steps for terminal processing of ultra-thin coaxial cables or simplify the process. Leading end portions of the cables each having a core conductor wire, an inner insulating layer for covering the core conductor wire, an outer conductor-shielding layer for covering the inner insulating layer, and an outer insulating layer for covering the outer conductor-shielding layer are processed to remove the outer conductor-shielding and outer insulating layers thereby to bare the inner insulating layer. Then, the cables are sandwiched between first and second housing parts while receiving a certain pressure up and down, during which piercing terminals tear holes in the outer insulating layer of the respective cables to be electrically connected to the outer conductor-shielding layer, and U-shaped leading end portions of press-connecting contacts tear holes in the inner insulating layer to be electrically connected to the core conductor wire.

7 Claims, 26 Drawing Sheets

PRESSURE CONNECTION STRUCTURE WITH COAXIAL CABLE

CROSS-REFERENCE TO RELATED APPLICATIONS

This application is based upon and claims the benefits of priorities from Japanese Patent Application Nos. 2003-393021 and 2003-404849 filed on Nov. 21, 2003 and Dec. 3, 2003, respectively, the entire contents of which are incorporated herein by reference.

This application is related to a co-pending U.S. patent application entitled "PIERCING TERMINAL FOR COAXIAL CABLE" and being filed on even date herewith. The co-pending application is expressly incorporated herein by reference.

FIELD OF THE INVENTION

The present invention relates to a pressure connection structure with coaxial cables, especially a pressure connection structure for coaxial cables using piercing terminals. More particularly, it relates to a pressure connection structure for coaxial cables using piercing terminals suitable for connections with outer coaxial cables and a connector utilizing the pressure connection structure.

RELATED ART

In regard to compact electronic systems such as notebook-sized personal computer, cellular telephones, and digital video cameras, systems with their involved devices movably mounted in various forms have been in common use in recent years because of good usability. Examples of such electronic systems include one having a liquid crystal display device which can be folded and superposed on its main body or swung about the body. In the case where a signal and a power source are supplied to such display device, a flexible cable has been mainly used in the past. However, a coaxial cable has been recently often used for such movable electrically-connecting portion instead of a flexible cable as described above in the context of the debut of a thinner coaxial cable having an outer diameter of 0.5 mm as an ultra-thin coaxial cable.

As a pressure connection structure for such coaxial cable, a pressure connection structure in which a piercing terminal is applied (e.g. JP-A-2001-223039) has been previously known.

In JP-A-2001-223039, as shown in FIG. 23, a piercing terminal 100 for a coaxial cable is connected to a coaxial cable 150 composed of: a core conductor wire 151; an inner insulating layer 152 for covering the core conductor wire 151; a cancellate outer conductor-plexus-shielding layer 153 for covering the inner insulating layer 152; and an outer insulating layer 154. A pair of rivet-like cuspidated portions 101 of the piercing terminal 100 is aligned so as not to come into contact with the core conductor wire 151. In this situation, the cuspidated portions 101 designed for piercing tear holes in the outer and inner insulating layers 154 and 152 and are inserted in the insulating layers. As a result, the piercing terminal 100 is electrically connected to the outer conductor-plexus-shielding layer 153.

Further, in the case where a ultra-thin coaxial cable 150 is used in a movable portion of a compact electronic system as described above, a plurality of ultra-thin coaxial cables 150 can be used for connection with a main circuit board such as a mother board so as to transmit signals to be transmitted in parallel, as shown in FIG. 25. The kind of such signals tends to further increase as a component to which the signals are transmitted grows to be more sophisticated, for example, as in the case of a liquid crystal capable of displaying in color. In the case where a plurality of coaxial cables 150 are used to constitute a harness for transmitting signals like this, ultra-thin coaxial cables 150 are not individually connected by a connecting means such as solder as shown in FIG. 25, but previously fixed to one connector 156 of a male/female connector densely at predetermined intervals, thereby to enable the plurality of ultra-thin coaxial cables 150 to be connected to the other connector 157 nearer to a main circuit board as described above, all at once, as shown in FIG. 24.

However, in the case where a plurality of ultra-thin coaxial cables 150 are fixed to one side of the connector in this way, when the ultra-thin coaxial cables 150 are as ultrathin as 1 mm or less in diameter, it becomes difficult to mount the cables to the connector.

In regard to the mounting of a ultra-thin coaxial cable on a connector, for example, in JP-A-2001-223039, connection to the core conductor wire 151 can be established by press-connecting the piercing terminal 100, while connection of the outer conductor-plexus-shielding layer 153 requires that the outer conductor-plexus-shielding layer 153 is previously bared and then connected to a ground terminal of a contact. Accordingly, the number of steps required to process a terminal of the ultra-thin coaxial cable 150 is increased.

SUMMARY OF THE INVENTION

The first object of the invention is to provide a pressure connection structure for coaxial cables, which can reduce the number of steps required to process terminals of ultra-thin coaxial cables 150 or simplify the process.

In addition, in the case where ultra-thin coaxial cables 150 as described above are press-connected, it is preferable to minimize the pitch between ultra-thin coaxial cables 150 in order to attain connections at a higher density by use of ultra-thin coaxial cables. This is because the significance of using ultra-thin cables might be otherwise weakened. Further, it is preferable to form the piercing terminal 100 itself from a thin plate thereby to make the space occupied by the piercing terminal as small as possible. What is desired is to enhance the rigidity of a connection structure with coaxial cables to the extent that the connection structure can withstand pressure connection while avoiding widening the pitch between coaxial cables.

The second object of the invention is to provide a pressure connection structure for piercing terminals suitable for connection of coaxial cables at a higher density.

In regard to the piercing terminal disclosed in JP-A-2001-223039, when the distance L between the core conductor wire 151 and outer conductor-plexus-shielding layer 153 is compared with the distance L1 between the core conductor wire 151 and the piercing terminal 100 electrically connected to the outer conductor-plexus-shielding layer 153, it is found that L and L1 are in the relation L>L1, as shown in FIG. 23. As a result, the impedance between the core conductor wire 151 and outer conductor-plexus-shielding layer 153 is varied at a location where the piercing terminal is connected in an axial direction of the coaxial cable 150. That is, impedance variations occur in the axial direction of the coaxial cable.

The third object of the invention is to avoid impedance variations which may remarkably affect transmission of minute signals.

In consideration of the foregoing, the invention provides a pressure connection structure with coaxial cables arranged as described below.

A pressure connection structure with coaxial cables, characterized by including:

a first housing part having first and second surfaces;

a plurality of piercing terminals, each including a pair of clipping pieces composed of conductive metal thin plates, a pair of piercing blades formed in leading ends of the paired clipping pieces respectively, a pair of curved portions, two pairs of reinforcing ribs;

a plurality of piercing terminal-receptacle holes for receiving the respective piercing terminals formed in the first housing part in a line at predetermined regular intervals, one of the piercing terminals inserted and embedded in each piercing terminal-receptacle hole from a side of the second surface of the first housing part with the paired piercing blades of the piercing terminal protruding outwardly from the hole;

a second housing part having first and second surfaces;

a plurality of press-connecting contacts, each including a U-shaped leading end portion, the plurality of press-connecting contacts provided in the second housing part so that the U-shaped leading end portion of each press-connecting contact protrudes from the second surface of the second housing part in a direction in parallel with the direction of combination with the first housing part and opposite to a direction in which the plurality of piercing terminals are embedded in the first housing part, a plurality of coaxial cables, each having a core conductor wire, an inner insulating layer for covering the core conductor wire, an outer conductor-shielding layer for covering the inner insulating layer, and an outer insulating layer for covering the outer conductor-shielding layer, a leading end portion of each coaxial cable processed so that the outer conductor-shielding layer and outer insulating layer are removed to bare the inner insulating layer, wherein the plurality of piercing terminals provided in the first housing part coincide in number with the plurality of press-connecting contacts provided in the second housing part, the plurality of coaxial cables are sandwiched between the first and second housing parts under a predetermined pressure, and each piercing terminal tears a pair of holes in the outer insulating layer of locationally-corresponding one of the coaxial cables to be electrically connected to the outer conductor-shielding layer of the cable, and the U-shaped leading end portion of each press-connecting contact tears a hole in the inner insulating layer of locationally-corresponding one of the coaxial cables to be electrically connected to the core conductor wire of the cable.

In such pressure connection structure with coaxial cables, the protruding direction of the pair of piercing blades of each piercing terminal embedded in the first housing part is opposite to the direction in which the U-shaped leading end portion of each press-connecting contact in the second housing part protrude therefrom. On this account, especially in the case where the coaxial cables are ultra-thin cables with a diameter of 0.5 mm or less, more reliable pressure connection can be made. In other words, each piercing terminal in the first housing part tear a pair of holes in outer insulating layer in an up and down direction, and each press-connecting contact in the second housing part tear a hole in the inner insulating layer in a direction different from the direction in the case of the piercing terminals, which makes it possible to tear holes in the inner and outer insulating layers while a coaxial cable is pressed and sandwiched from the different directions by the paired clipping pieces of each piercing terminal and the U-shaped leading end portion of each press-connecting contact. This can avoid the risk that an unstable coaxial cable in the housing may be displaced, thereby causing the piercing terminal to short-circuit with the core conductor wire.

The pressure connection structure with coaxial cables, characterized by further including a pectinated flat-plate-shaped ground terminal of a conductive material having first and second comb tooth-like members, the ground terminal provided in a place in the second housing part opposed to the plurality of piercing terminals provided in the first housing part when the second housing part and the first housing part are combined up and down, one of the first comb tooth-like members disposed between the locationally-corresponding paired clipping pieces, two of the second comb tooth-like members nearest to the one first comb tooth-like member disposed outside the locationally-corresponding paired clipping pieces, wherein each of the plurality of piercing terminals includes: a pair of clipping pieces opposed to and substantially in parallel with each other, and spaced by a distance larger than an outer diameter of the core conductor wire and smaller than an outer diameter of the inner insulating layer;

a pair of piercing blades formed by chamfering leading ends of the paired clipping pieces into tapers of each piercing terminal;

a pair of curved portions interposed in the respective clipping pieces and formed so as to take forms outwardly convex with respect to the respective clipping pieces and uninterrupted across the width of the clipping pieces; and two pairs of reinforcing ribs, each pair extending from corresponding one of the curved portions toward the leading end and/or the rear end of the corresponding clipping piece.

According to the above pressure connection structure, when the first and second housing parts are combined up and down, one of the first comb tooth-like members is disposed between the locationally-corresponding paired clipping pieces, and two of the second comb tooth-like members nearest to the one first comb tooth-like member are disposed outside the locationally-corresponding paired clipping pieces. This can avoid the risk that when the piercing blades of the clipping pieces tear holes in outer insulating layer, the tearing stress produced by tearing holes in the outer insulating layer may cause deformation of the clipping pieces thereby to widen or narrow the clearance between them.

Also, even in the case where a ultra-thin conductive metal plate is adopted for the clipping pieces, two pair of reinforcing ribs each extending from corresponding one of the curved portions toward the leading end and/or the rear end of the corresponding clipping piece are provided, thereby making it possible to realize high density pressure connection in the condition where the rigidity is enhanced and the distance between coaxial cables is narrowed. In other words, it is intended here to prevent the curved portions partially formed as described above from causing the decrease in rigidity of the piercing terminal when a thin metal plate is used to form the piercing terminal. In the case where the clipping pieces are formed from a thin metal sheet, the curved portions provided extending in a direction perpendicular to the direction of inserting the pair of clipping pieces may work as mechanical springs under the action of a stress caused by stabbing the pair of clipping pieces into the outer insulating layer. In such case it becomes harder to insert the clipping pieces, and therefore the clipping pieces may be inserted in a wrong direction to cause short circuit. However, such case can be prevented by providing the reinforcing ribs as described above.

Further, since the paired clipping pieces of each piercing terminal are opposed to and substantially in parallel with each other, and spaced by a distance larger than an outer diameter of the core conductor wire and smaller than an outer diameter of the inner insulating layer, the piercing terminal can be prevented from short-circuiting with the core conductor wire. Moreover, the paired curved portions are interposed in the respective clipping pieces and formed so as to take forms outwardly convex with respect to the respective clipping pieces and uninterrupted across the width of the clipping pieces and as such, it is possible to sufficiently ensure an area for the electrical contact between the outer conductor-shielding layer and the paired clipping pieces.

In addition, the two pairs of reinforcing ribs may be composed of two rows of reinforcing ribs arrayed in parallel in a direction of a width of the corresponding one of the clipping pieces, and extend in the same direction as the first and second housing parts are combined, and the two rows of reinforcing ribs may define therebetween a ground-terminal-receiving groove for receiving the ground terminal.

According to this arrangement, the ground terminal is inserted in the ground-terminal-receiving groove for receiving the ground terminal provided between the reinforcing ribs, whereby the clearance between the clipping pieces can be retained, and the clipping pieces and the ground terminal can be maintained in a certain locational relation in a longitudinal direction of the ground terminal as described above. Also, it is possible to prevent the displacement of the first and second housing parts relative to each other in the condition where the first and second housing parts are assembled up and down.

The pressure connection structure with coaxial cables, characterized in the plurality of coaxial cables are disposed in a common plane at regular intervals, the processed leading end portions of the plurality of coaxial cables with their outer conductor-shielding layers and outer insulating layers removed and the inner insulating layers bared are laminated with a first resin sheet, portions of the coaxial cables spaced from the portions of the coaxial cables laminated with the first resin sheet by a distance larger than a distance between each piercing terminal and the corresponding press-connecting contact, which are to be press-connected to the coaxial cable, are laminated with a second resin sheet.

According to this arrangement, the leading end portions of the coaxial cables with their inner insulating layers bared are laminated with a first resin sheet, whereas portions of the coaxial cables spaced from the coaxial cables' leading end portions laminated with the first resin sheet by a distance larger than a distance between each piercing terminal and the corresponding press-connecting contact, which are to be press-connected to the coaxial cable, are laminated with a second resin sheet. This makes it possible to press-connect the piercing terminals and press-connecting contacts with a plurality of coaxial cables all at once upon putting the plurality of coaxial cables between the first and second housing parts all at once to hold the cables therebetween. Therefore, the pressure-connection structure according to the invention has an advantage such that the press-connection work can be simplified significantly. In addition, the first and second resin sheets are spaced apart by a distance larger than the distance between each piercing terminal and its corresponding press-connecting contact, which are to be press-connected to the coaxial cable, and as such, the first and second resin sheet can be prevented from interfering with the press-connecting work.

According to the above-described pressure connection structure with coaxial cables, the protruding direction of the pair of piercing blades of each piercing terminal embedded in the first housing part is opposite to the direction in which the U-shaped leading end portion of each press-connecting contact in the second housing part protrudes therefrom. This simplifies the press-connecting work when the piercing terminals and press-connecting contacts are press-connected to the coaxial cables and therefore pressure connection can be made more reliably. Especially, in the case where ultra-thin coaxial cables having a diameter of 0.5 mm or less are bundled into a harness form to make their connections all at once, higher effects can be achieved.

Further features of the invention, its nature, and various advantages will be more apparent from the accompanying drawings and the following detailed description of the invention.

DESCRIPTION OF THE PREFERRED EMBODIMENT

The embodiments of the invention will be described below in reference to the drawings. The invention is not limited to the embodiments, and various changes and modifications may be made in design.

[First Embodiment]

Piercing Terminal

Figure 1:
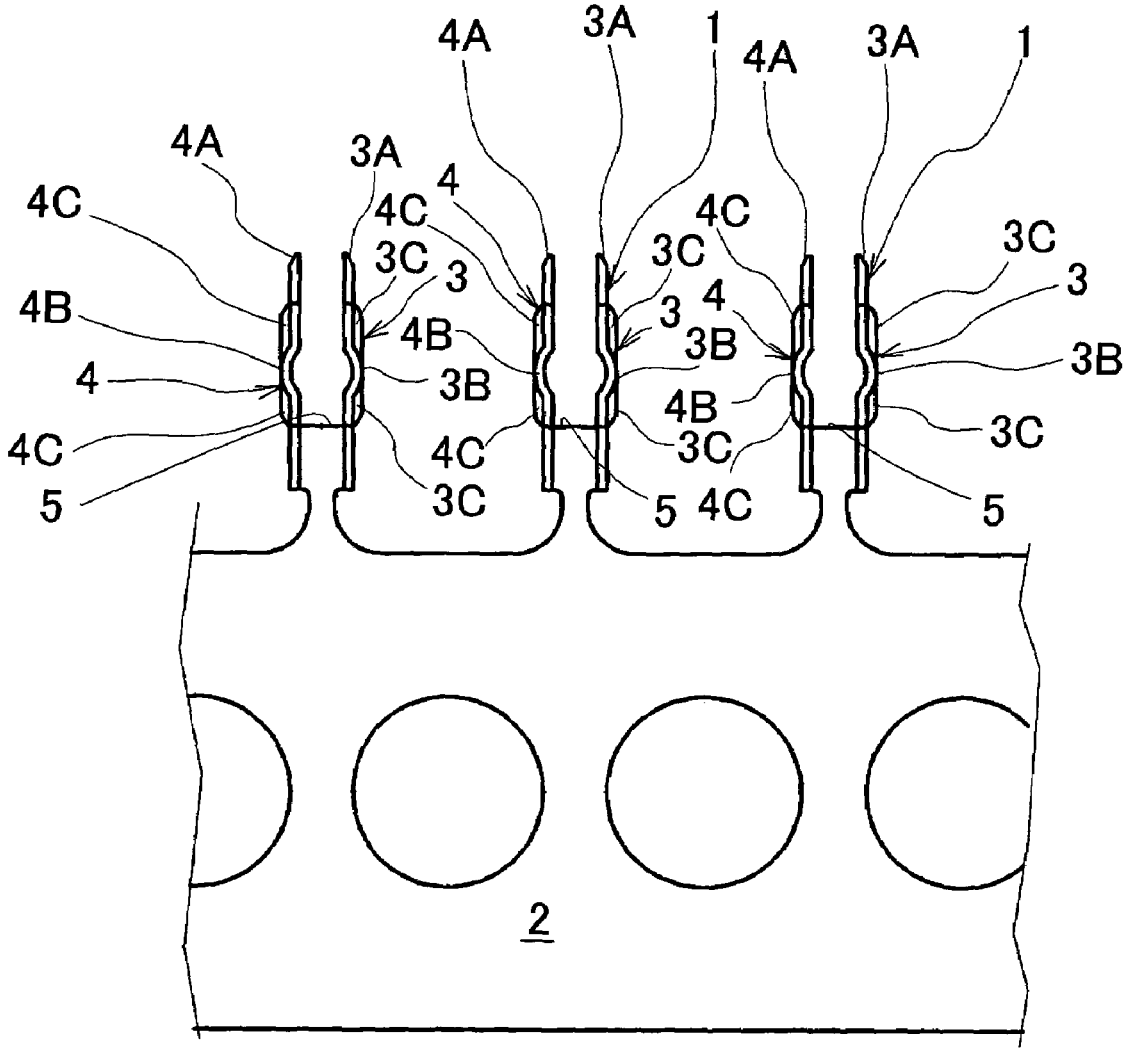
FIG. 1 is a front view showing a plurality of piercing terminals coupled in the form of a hoop in a manufacturing step.
Figure 2:
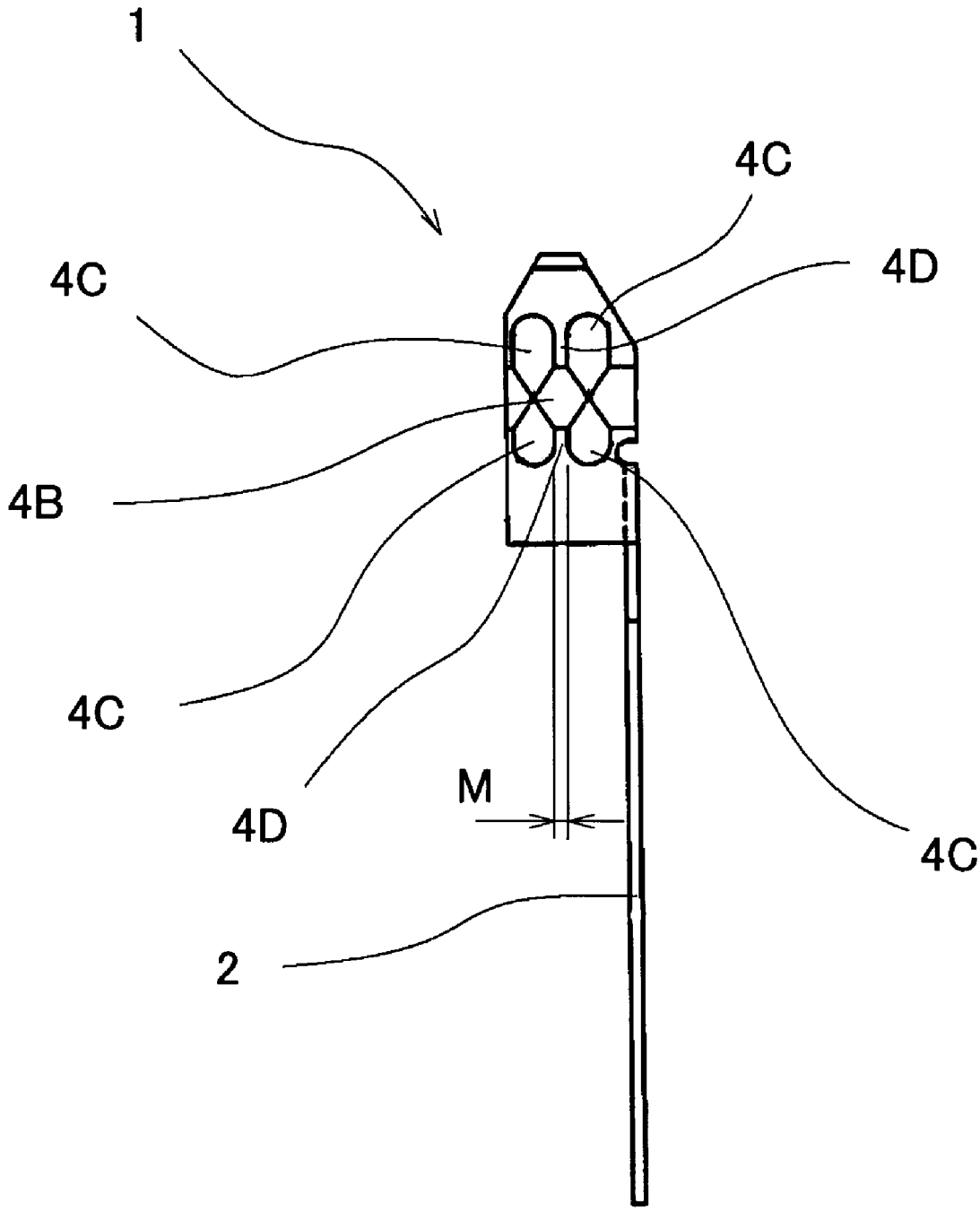
FIG. 2 is a side view of the coupled piercing terminals illustrated in FIG. 1.
Figure 3:
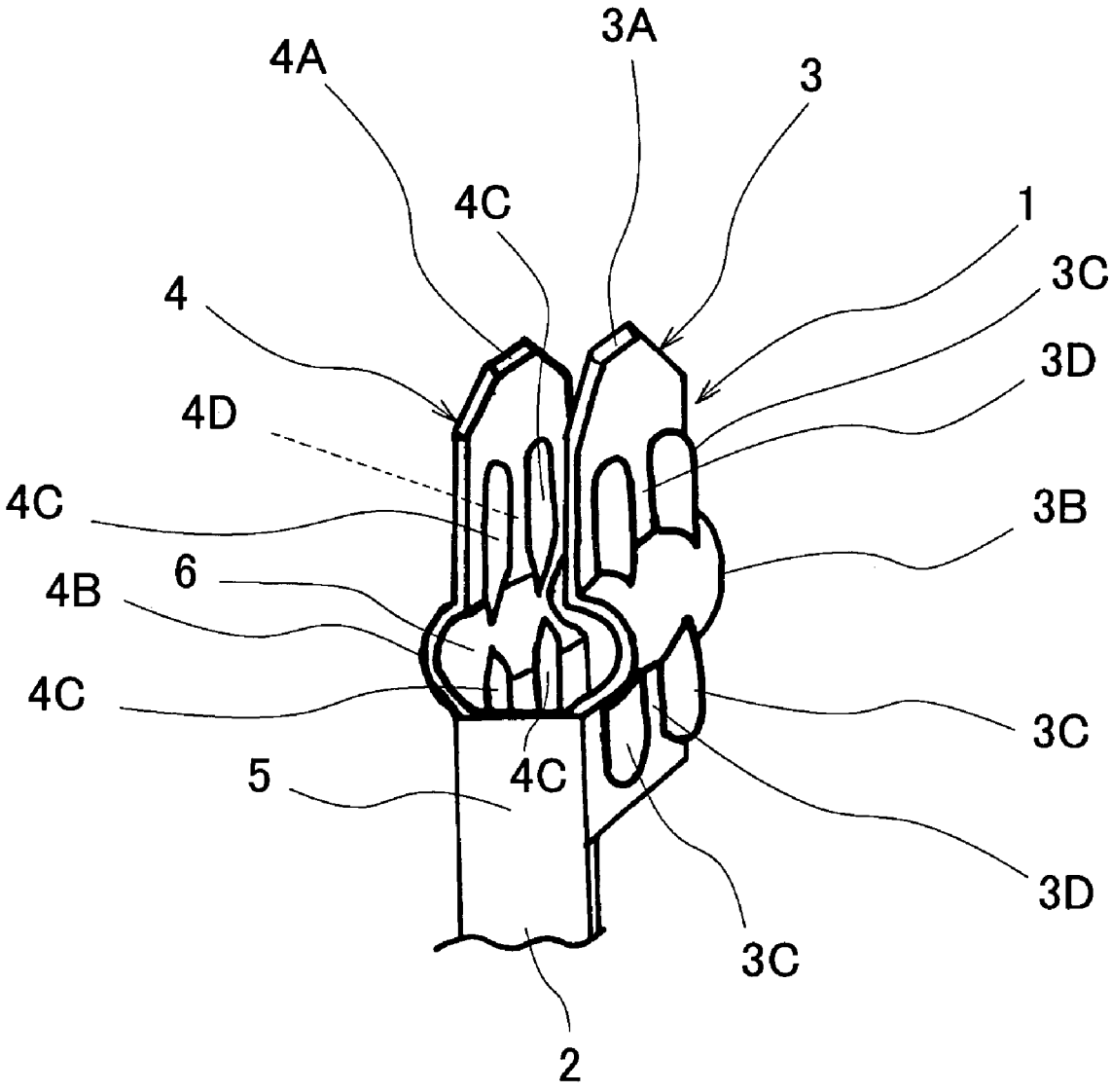
FIG. 3 is a partial perspective view of the coupled piercing terminals illustrated in FIG. 1.

A configuration of a piercing terminal according to the invention will be described in reference to FIGS. 1–3. FIG. 1 is a front view showing a plurality of piercing terminals coupled in the form of a hoop (i.e. in series) in a manufacturing step. FIG. 2 is a side view of the piercing terminal illustrated in FIG. 1. FIG. 3 is a partial perspective view of the piercing terminal illustrated in FIG. 1.

The piercing terminals 1 are formed into the form of a hooop (i.e. in series) by performing cutting, stamping, etc. with respect to a belt-shaped, thin conductive metal sheet, in which the piercing terminals 1 are coupled through a common member 2 at predetermined intervals as shown in FIG. 1.

The piercing terminals 1 illustrated in FIGS. 1–3 are press-inserted into a first housing part 10 from outside so that coaxial cables 50 (see FIG. 4, for example) can be held inside a housing constituted by the first housing part 10 and a second housing part 20. As a result of the insertion, the piercing terminals 1 are electrically connected to the coaxial cables 50.

As seen from the leading end of the piercing terminal 1, the piercing terminal has a pair of opposed clipping pieces 3, 4, and a coupling portion 5 for coupling base portions of the clipping pieces 3, 4 to each other, which take generally the form of a horseshoe in top view. The coupling portion 5 and the clipping pieces 3, 4 define an opening 6 for receiving a coaxial cable 50. The opening 6 leads to an accommodation space which is defined by the clipping pieces 3, 4 and is in communication with the outside.

Each clipping piece 3 (4) has a piercing blade 3A (4A) formed by chamfering a leading end of the clipping piece 3 (4) into a taper. Also, each clipping piece 3 (4) has a curved portion 3B (4B) provided in a vicinity of its base portion between the base portion located in the rear of the clipping piece (in a lower portion thereof in the drawing) and the piercing blade 3A (4A). Each curved portion 3B (4B) is formed so as to take an outwardly convex form with respect to the clipping piece 3 (4). The curved portions 3B, 4B pinch and hold a coaxial cable 50 therebetween by outer periphery portions of an outer conductor-shielding layer 53 of the coaxial cable, which is to be described later, thereby to come into face-to-face contact with the cable and establish a good electrical contact condition. In addition, the curved portions 3B, 4B are formed so as to extend in a direction perpendicular to the direction of stabbing the piercing terminal 1 into the coaxial cable 50 or in a direction which deviates from the direction of stabbing the piercing terminal 1.

Now, focusing on the rigidity of clipping pieces 3, 4 against an insertion force produced when the piercing terminal 1 is stabbed and inserted into the coaxial cable 50, it is expected that the rigidity should be reduced in the direction of stabbing the piercing terminal 1 into the coaxial cable by formation of the curved portions 3B, 4B. Then, the rigidity, which is thus weakened in the direction of stabbing the piercing terminal 1 into the coaxial cable 50, is built up by providing two pairs of reinforcing ribs 3C, 4C on the respective clipping pieces 3, 4 composed of belt-shaped, thin metallic plates. The pairs of reinforcing ribs 3C, 4C extend in an up and down direction in the drawing and are each shaped into a convex form. In other words, the two pairs of reinforcing ribs 3C, 4C are formed extending from the relevant curved portions 3B, 4B toward the leading and rear ends of the respective clipping pieces 3, 4 (upward and downward in the drawing). Also, each pair of reinforcing ribs 3C (4C) is composed of two rows of reinforcing ribs 3C (4C) which are provided in parallel in a direction of the width (i.e. the width of the belt-shaped form) of the clipping piece 3(4) adjacent to each curved portion 3B (4B); each row of reinforcing ribs 3C (4C) extends in the up and down direction in the drawing. Incidentally, the up and down direction is substantially identical with the direction in which the first and second housing parts 10, 20 are combined up and down. Each pair of reinforcing ribs 3C (4C) is formed by press working as convex portions extending toward the leading and rear ends of the respective clipping piece 3 (4) with the relevant curved portion 3B (4B) located in the middle thereof. Accordingly, the two pairs of reinforcing ribs 3C, 4C are formed protruding outwardly from the respective clipping pieces 3, 4 and their insides are recessed. As described above, the two pairs of the reinforcing ribs 3C, 4C are formed on the respective clipping pieces 3, 4 so as to be opposed to each other; each pair of the reinforcing ribs 3C (4C) is composed of paired reinforcing ribs 3C (4C) arrayed in parallel. Thus, a ground-terminal-receiving groove 3D (4D) is formed between the paired reinforcing ribs 3C (4C). In the ground-terminal-receiving groove 3D (4D), a pectinated rectangular flat-plate-shaped ground terminal 40 to be described later can be inserted. Each ground-terminal-receiving groove 3D (4D) has a width of M, which is arranged to be equal to the width of the ground terminal 40 or somewhat larger than the width so as to allow the insertion of the ground terminal 40. The ground terminal 40 is disposed in contact with the piercing terminal 1 electrically connected to the outer conductor-shielding layer 53 by press-connection, and therefore the ground terminal 40 is to be electrically connected to the outer conductor-shielding layer 53 indirectly. An outline-keeping comb tooth-like member 41 of the ground terminal 40 tears a hole in the outer insulating layer 54 made from a resin and is directly press-connected to the outer conductor-shielding layer 53, whereby an electrical connection is established therebetween. Further, the ground terminal 40 is arranged to serve as a ground when it is connected to an outer electrical circuit, etc. through a connector or by solder. It is preferable to arrange a pressure connection structure such that the width between the outline-keeping comb tooth-like members 41 is set at a value somewhat smaller than the outer diameter of the outer conductor-shielding layer 53 of the coaxial cable 50, thereby to ensure a good press-connection, i.e. a direct electrical connection, between the ground terminal 40 and the outer conductor-shielding layer 53.

Assembling Structure of Coaxial Cable and Piercing Terminal to Housing

Figure 4:
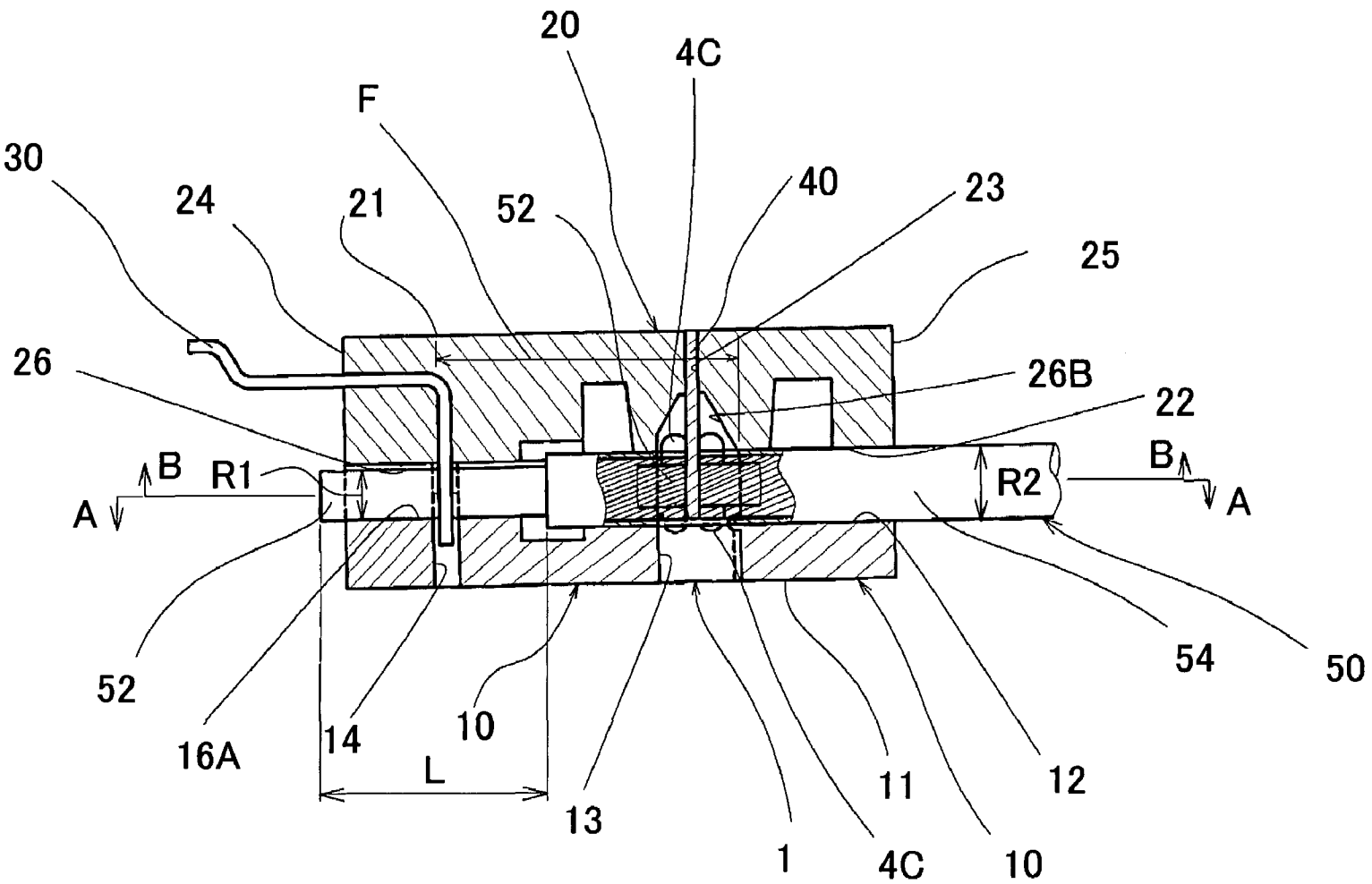
FIG. 4 is a side, longitudinal sectional view showing a pressure connection structure according to the invention in the half finished condition where the piercing terminal 1, a press-connecting contact 30, a ground terminal 40 and the coaxial cable 50 are incorporated in a housing composed of a first housing part 10 and a second housing part 20.
Figure 5:
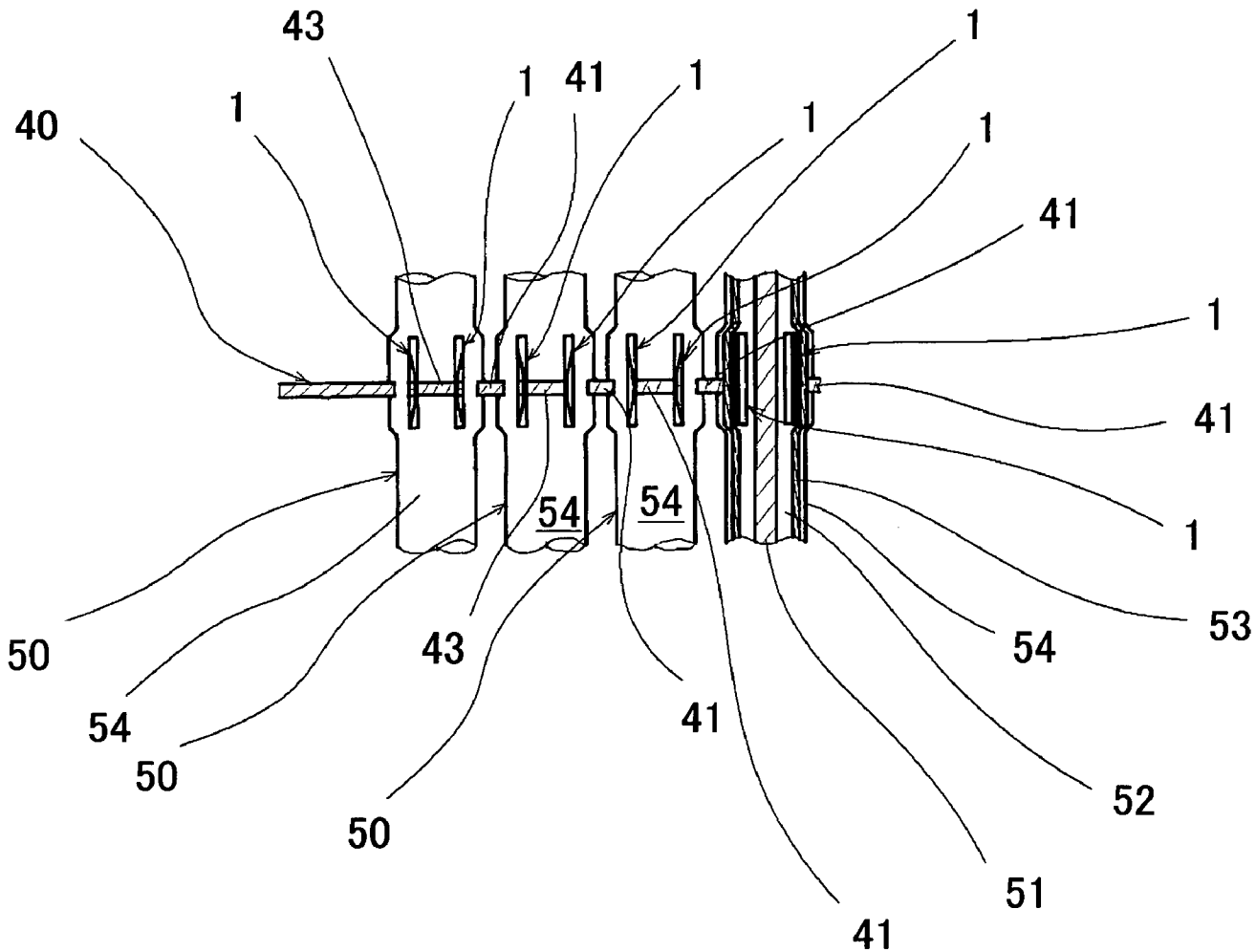
FIG. 5 is a partial bottom view of the pressure connection structure, partially showing a section taken along the line A—A in FIG. 4.
Figure 6:
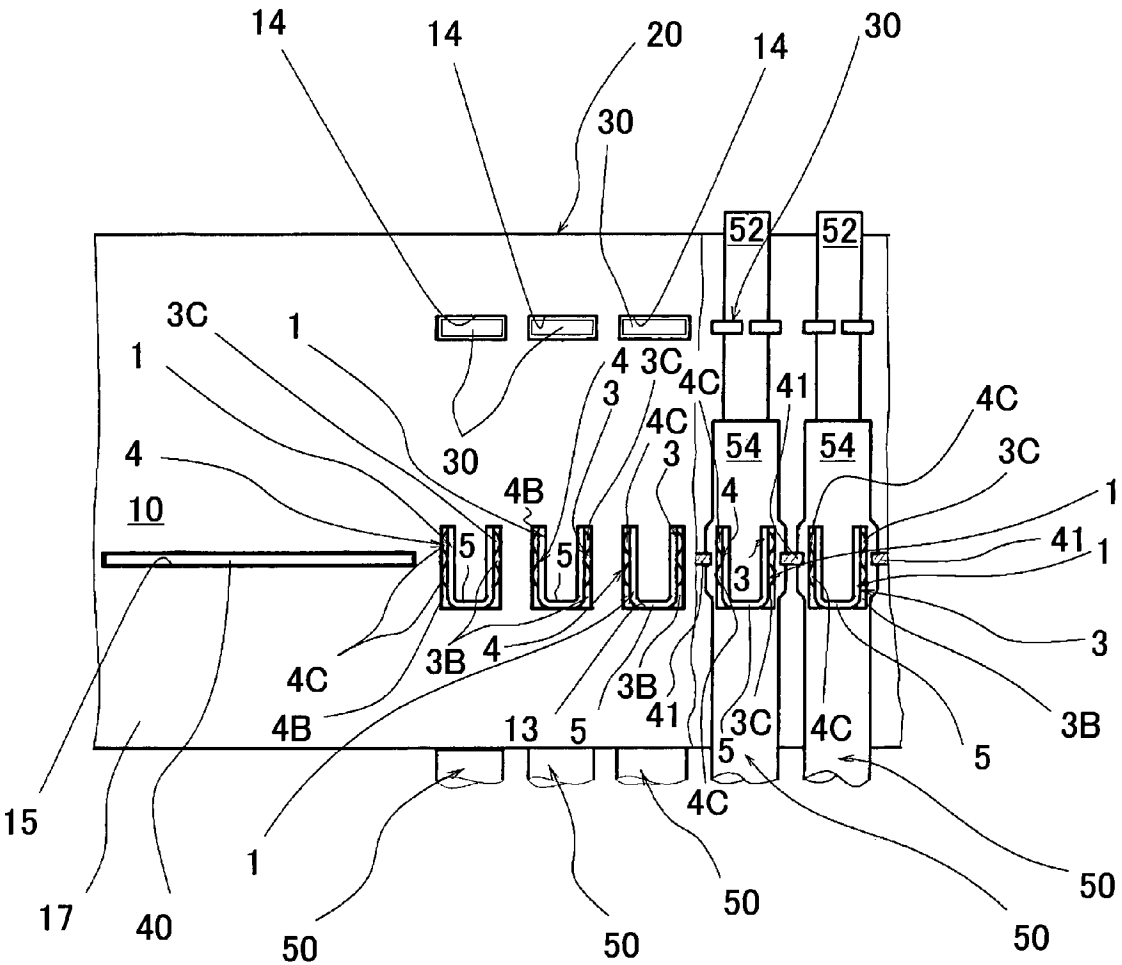
FIG. 6 is a sectional view of the pressure connection structure taken along the line B—B in FIG. 4.
Figure 7:
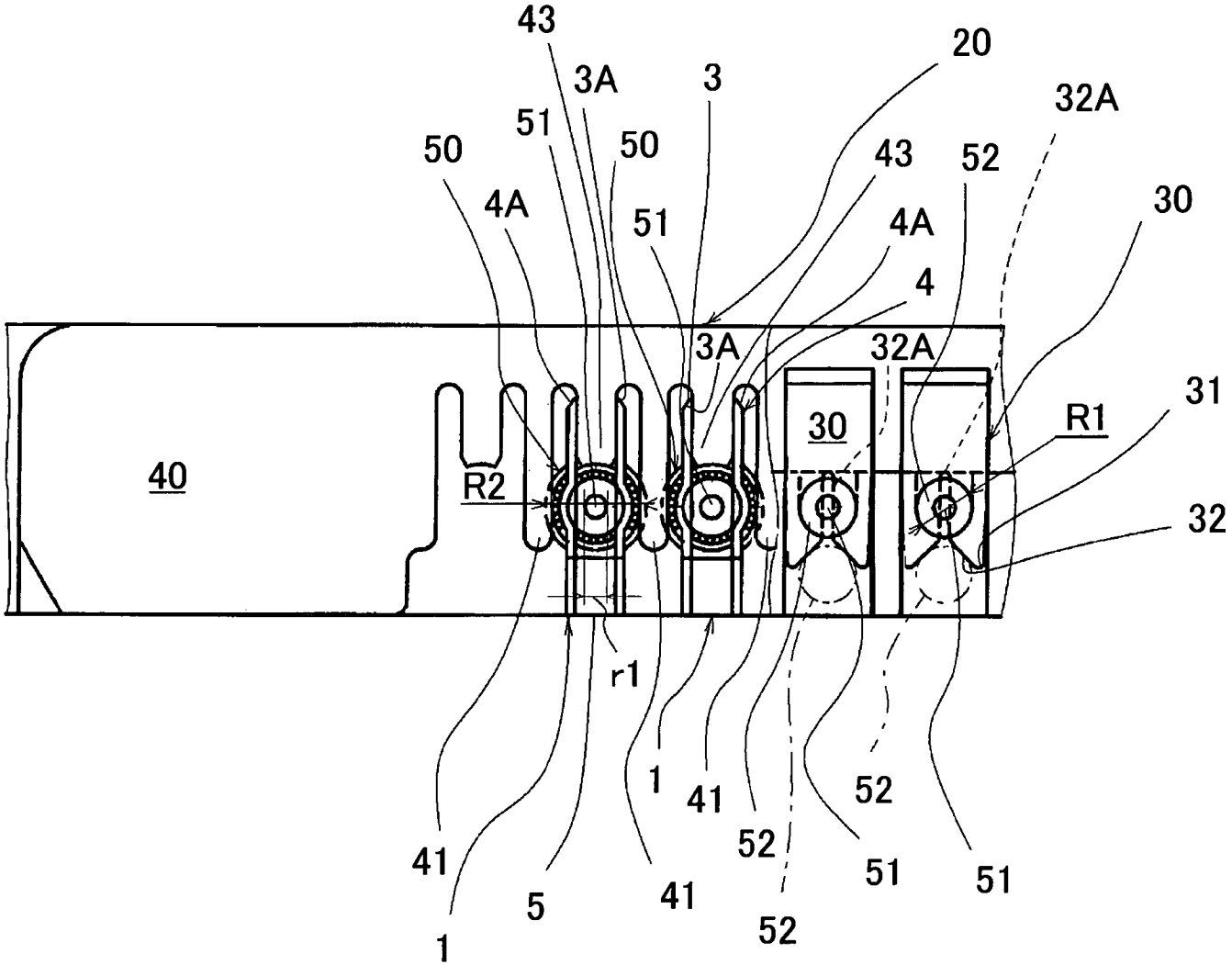
FIG. 7 is a front view of the pressure connection structure illustrated by FIG. 4.

An assembling structure of the piercing terminal 1 and coaxial cable 50 to a housing will be described in reference to FIGS. 4–7. FIG. 4 is a side, longitudinal sectional view showing the condition where the piercing terminal 1, a press-connecting contact 30, the ground terminal 40 and the coaxial cable 50 are incorporated in the housing composed of a first housing part 10 and a second housing part 20. FIG. 5 is a partial sectional view taken along the line A—A in FIG. 4. FIG. 6 is a sectional view taken along the line B—B in FIG. 4. FIG. 7 is a front view of the condition illustrated by FIG. 4.

The first housing part 10 is formed from an electrically-insulative resin material and takes a rectangular form in plane view. In the first housing part 10, a plurality of horseshoe-shaped piercing terminal-receptacle holes 13 for the piercing terminals 1 are pierced from the bottom surface 11 to the top surface 12. In other words, the first housing part 10 has a plurality of piercing terminal-receptacle holes 13 for receiving the respective piercing terminals 1 formed therein and arrayed in a line at predetermined intervals H. Each piercing terminal 1 includes a pair of clipping pieces 3, 4 composed of conductive metal thin plates. Each piercing terminal 1 is to be inserted into one of the terminal-receptacle holes 13, and then the piercing terminal 1 is to be embedded in the first housing part with its piercing blades 3A, 4A of its leading ends protruding outwardly.

The horseshoe-shaped terminal-receptacle holes 13 are provided in a longitudinal direction of the first housing part 10 at predetermined intervals H, while in a location opposite to the location of the horseshoe-shaped piercing terminal-receptacle hole 13 for each piercing terminal 1 in a shorter side direction of the first housing part 10 is formed a contact-receptacle hole 14 for the press-connecting contact 30, penetrating the first housing part 10 from its bottom surface 11 to the top surface 12.

Further, on a prolongation of a straight line segment along which the horseshoe-shaped terminal-receptacle holes 13 are arrayed in parallel, there is formed a ground-terminal-receptacle hole 15 for receiving the pectinated rectangular flat-plate-shaped ground terminal 40 penetrating the first housing part 10 from its top surface 12 to the bottom surface 11.

Meanwhile, the second housing part 20 has a ground-terminal-receptacle hole 23 formed in a location which agrees with the location of the above-described ground-terminal-receptacle hole 15 when the first and second housing parts 10, 20 are assembled up and down; the ground-terminal-receptacle hole 23 penetrates the second housing part from its top surface 21 to the bottom surface 22 and has the same form as the ground-terminal-receptacle hole 15.

Then, in the condition where the coaxial cable 50 is disposed in place on the first housing part 10, the second housing part 20 containing the press-connecting contacts 30 is pressed against the first housing part 10 from above, while the ground terminal 40 is inserted into the ground-terminal-receptacle holes 23, 15, and the piercing terminals 1 are inserted into the horseshoe-shaped terminal-receptacle holes 13, whereby the piercing terminals 1 are assembled to the housing. In this situation, just stabbing the piercing terminal 1 into the coaxial cable 50 can electrically connect the outer conductor-shielding layer of the coaxial cable 50 with the ground terminal 40 through the piercing terminal 1. This is because the first and second housing parts 10, 20 are made from an insulative material. This connecting method is to be described later in reference to FIGS. 22A–22H.

First Housing Part

Figure 8:
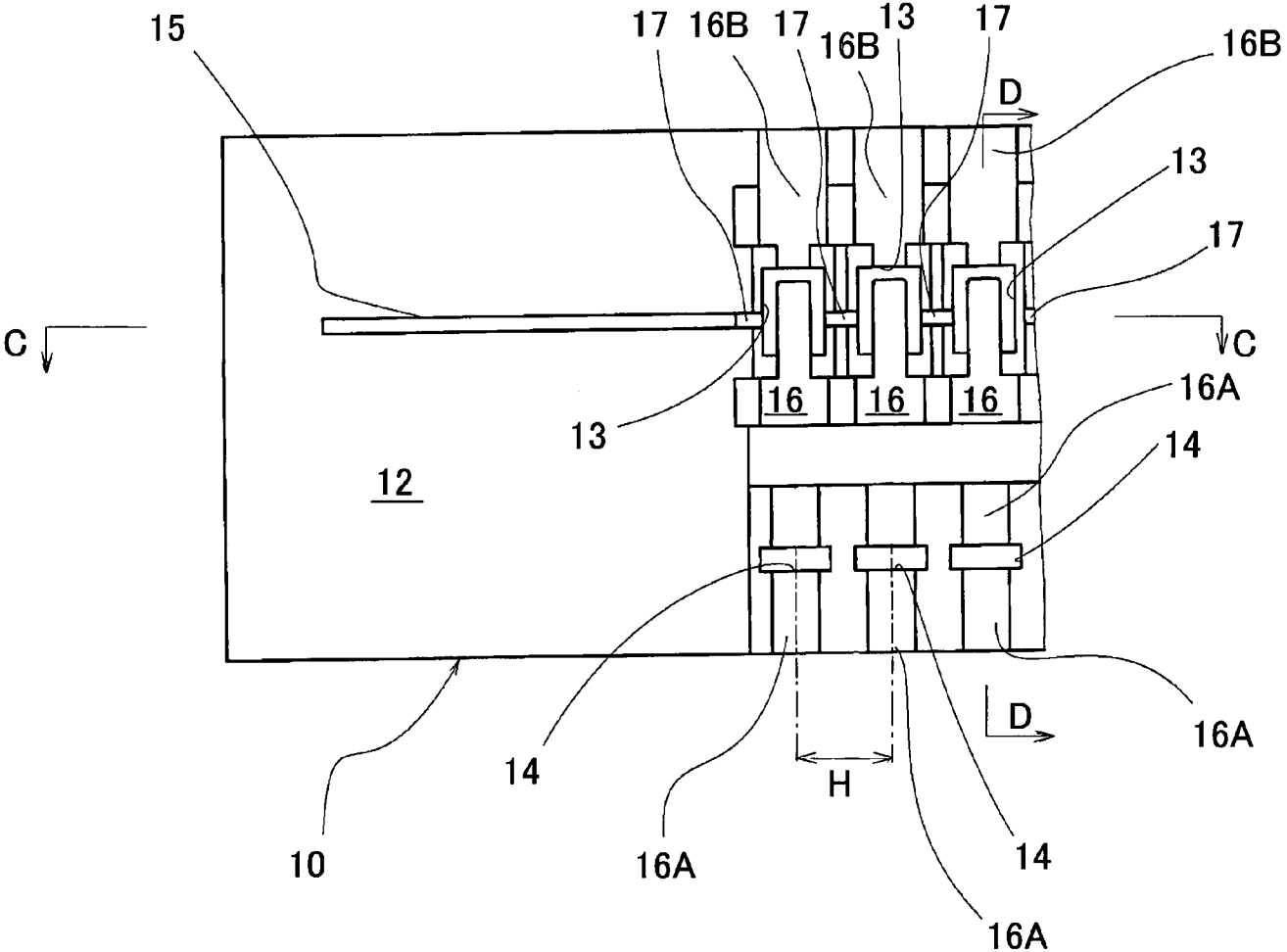
FIG. 8 is a plane view partially broken away of the first housing part.
Figure 9:
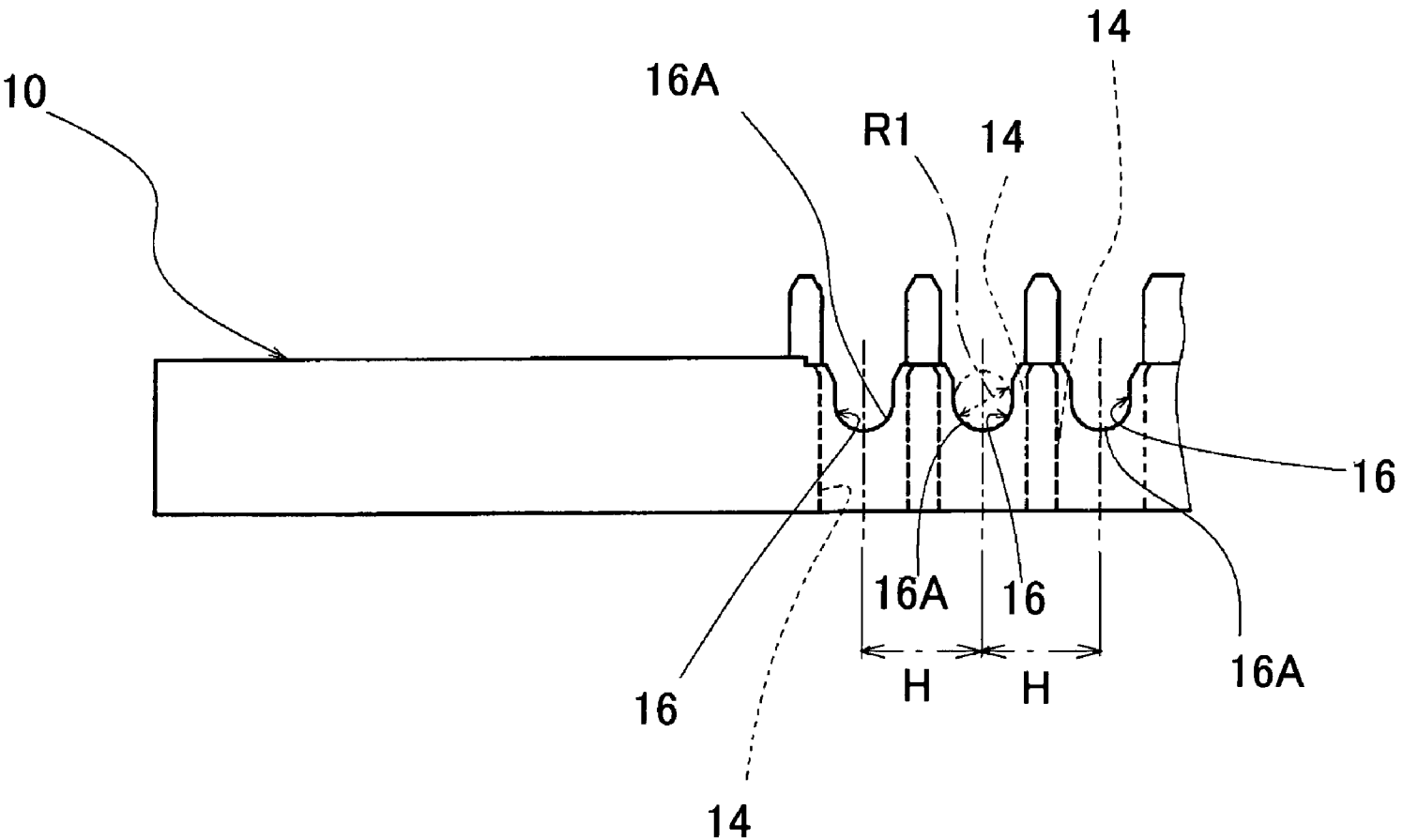
FIG. 9 is a front view of the first housing part illustrated by FIG. 8.
Figure 10:
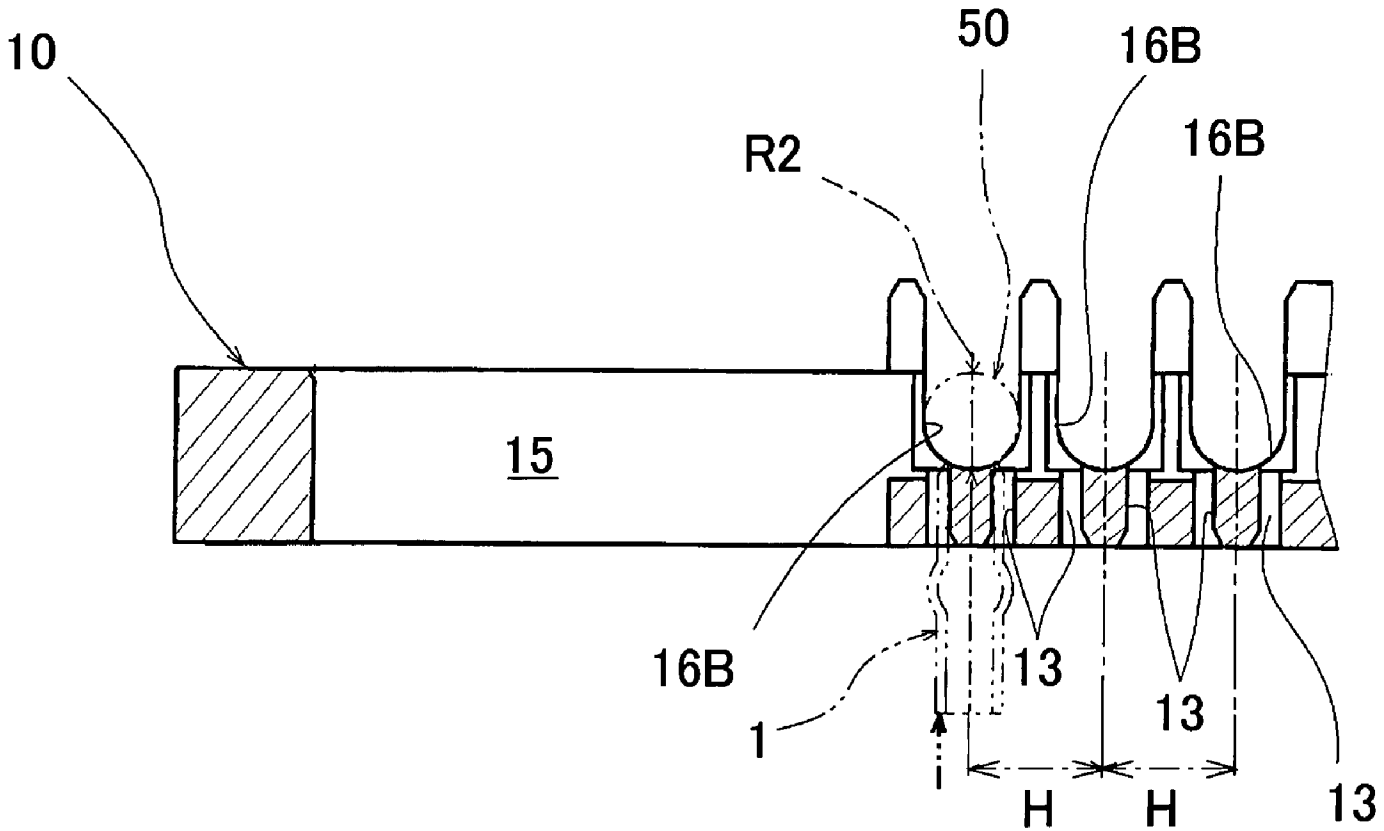
FIG. 10 is a sectional view of the first housing part taken along the line C—C in FIG. 8.
Figure 11:
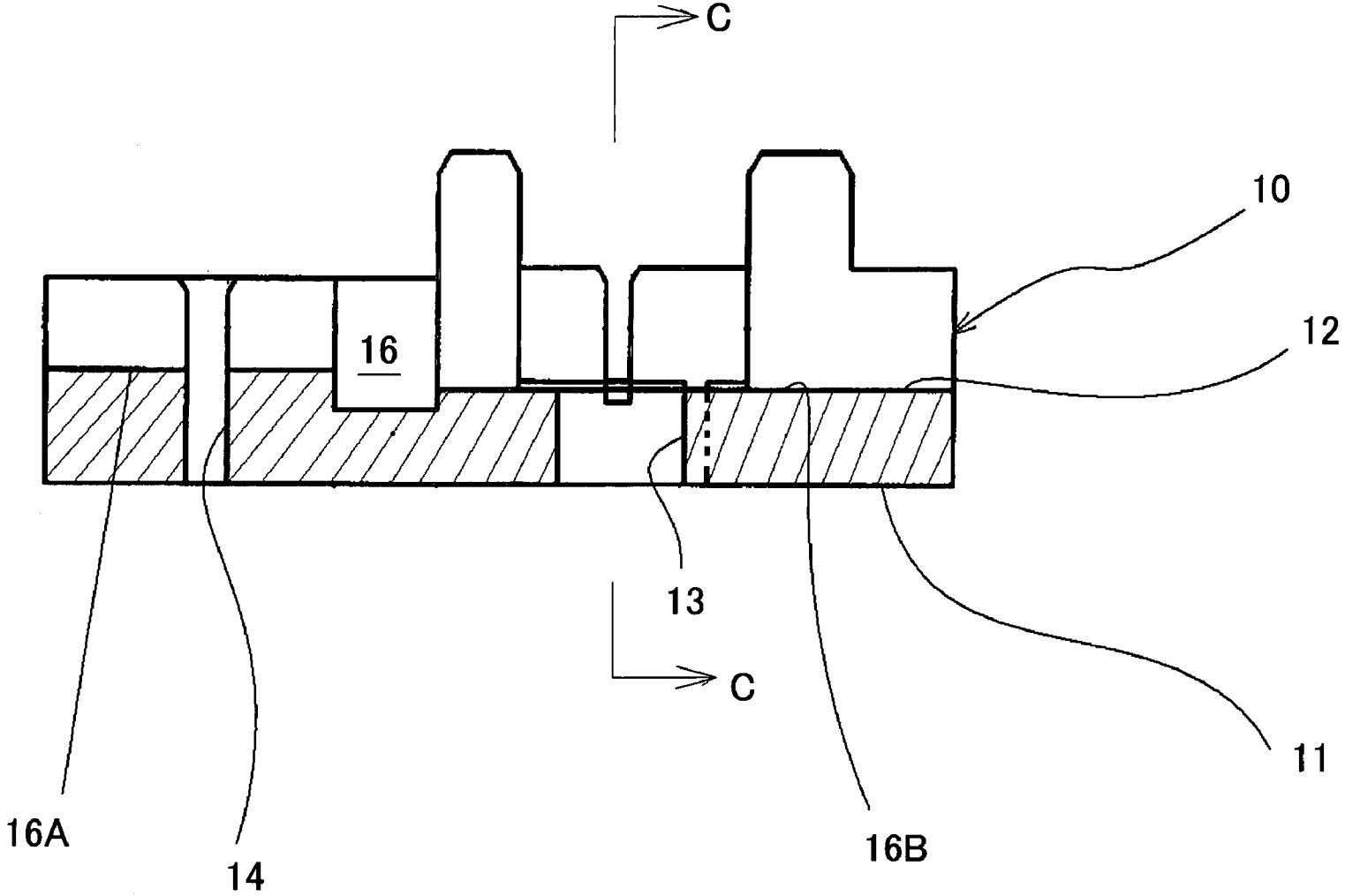
FIG. 11 is a sectional view of the first housing part taken along the line D—D in FIG. 8.

The first housing part 10 will be described here in reference to FIGS. 8–11. FIG. 8 is a plane view partially broken away of the first housing part 10. FIG. 9 is a front view of the first housing part illustrated by FIG. 8. FIG. 10 is a sectional view of the first housing part taken along the line C—C in FIG. 8. FIG. 11 is a sectional view of the first housing part taken along the line D—D in FIG. 8.

The first housing part 10 is composed of an insulative material made by molding of a resin, etc. As described above, the first housing part 10 takes a rectangular form in plane view, and has a plurality of horseshoe-shaped terminal-receptacle holes 13 for piercing terminals 1 pierced therein; the horseshoe-shaped terminal-receptacle holes 13 penetrate the first housing part 10 from its bottom surface 11 to the top surface 12 and are arrayed at predetermined intervals H along a longer side direction of the first housing part 10. In a location opposite to the location of the horseshoe-shaped piercing terminal-receptacle hole 13 for each piercing terminal 1 in a shorter side direction of the first housing part 10 is formed a contact-receptacle hole 14 for the press-connecting contact 30, penetrating the first housing part 10 from its bottom surface 11 to the top surface 12.

Also, the first housing part 10 has a cable-receiving groove 16 for each coaxial cable 50 provided in the top surface 12 thereof astride the horseshoe-shaped piercing terminal-receptacle hole 13 and the contact-receptacle hole 14 opposite to the terminal-receptacle hole 13. A coaxial cable 50 to be placed in the cable-receiving groove 16 is widely known, which is composed of a core conductor wire 51, an inner insulating layer 52 for covering the core conductor wire 51, an outer conductor-shielding layer 53 for covering the inner insulating layer 52, and an outer insulating layer 54 for covering the outer conductor-shielding layer 53, as shown in FIG. 4.

At the time when a coaxial cable 50 is placed in the cable-receiving groove 16, the coaxial cable 50 has been preprocessed, thereby having made its outer conductor-shielding layer 53 and outer insulating layer 54 stripped off by a predetermined length of L from its leading end and bared the inner insulating layer 52. Thus, the coaxial cable 50 takes the form of a cable with a shoulder such that the cable has a diameter R1 in a range up to the predetermined length L from its end along its length and has another diameter R2 larger than R1 in the remaining range. According to the geometrical condition, each cable-receiving groove 16 is composed of a groove 16A arc-shaped in section having the diameter R1 and a groove 16B arc-shaped in section having the diameter R2. Herein, the groove 16A lies in a range of from the leading end of the cable-receiving groove 16 to a distance away from the leading end by a length shorter than L, the range including the contact-receptacle hole 14; and the groove 16B lies in the remaining range, i.e. the range starting from a distance away from the leading end by the length L.

Further, on a prolongation of a straight line segment along which the horseshoe-shaped terminal-receptacle holes 13 are arrayed in parallel, there is formed a ground-terminal-receptacle hole 15 for the pectinated rectangular flat-plate-shaped ground terminal 40 penetrating the first housing part 10 from its top surface 12 to the bottom surface 11. Further, in the top surface 12 between adjacent horseshoe-shaped terminal-receptacle holes 13, there are individually provided outline-keeping member-receiving grooves 17 each having a predetermined depth for receiving the outline-keeping comb tooth-like member 41 of the ground terminal 40 for keeping the outline of a coaxial cable 50. The distance between the outline-keeping comb tooth-like members 41 is set to be smaller than R2 so as to put the a coaxial cable 50 between the outline-keeping comb tooth-like members 41 and hold it from outside the outer insulating layer 54, i.e. a portion of the cable with the largest diameter.

Ground Terminal

Figure 12A:
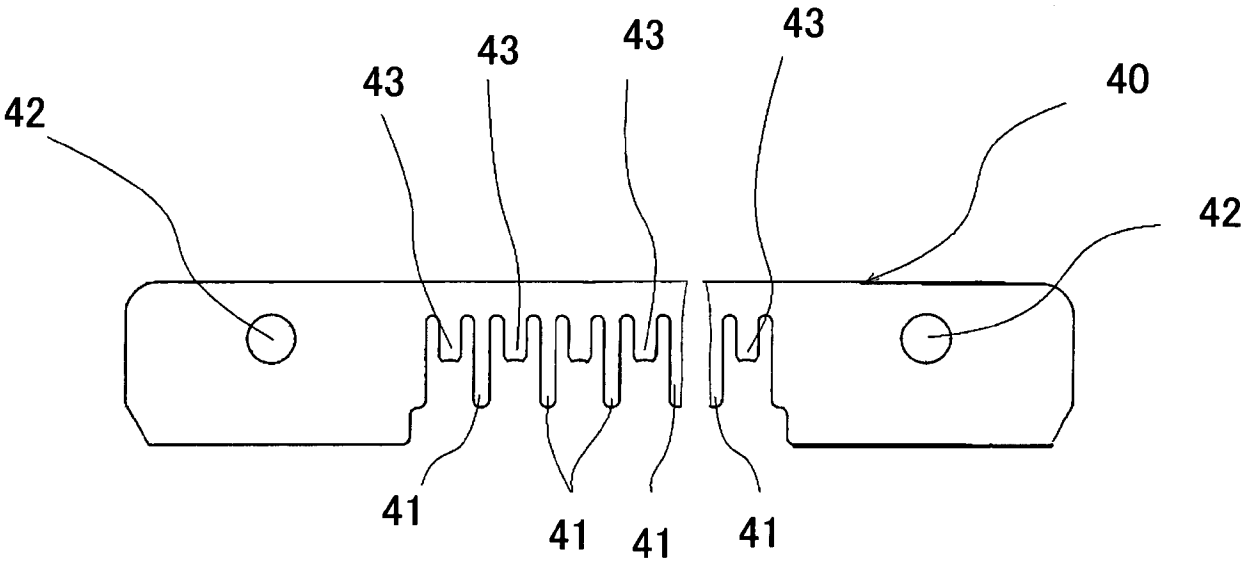
FIG. 12A is a front view of the ground terminal 40.
Figure 12B:
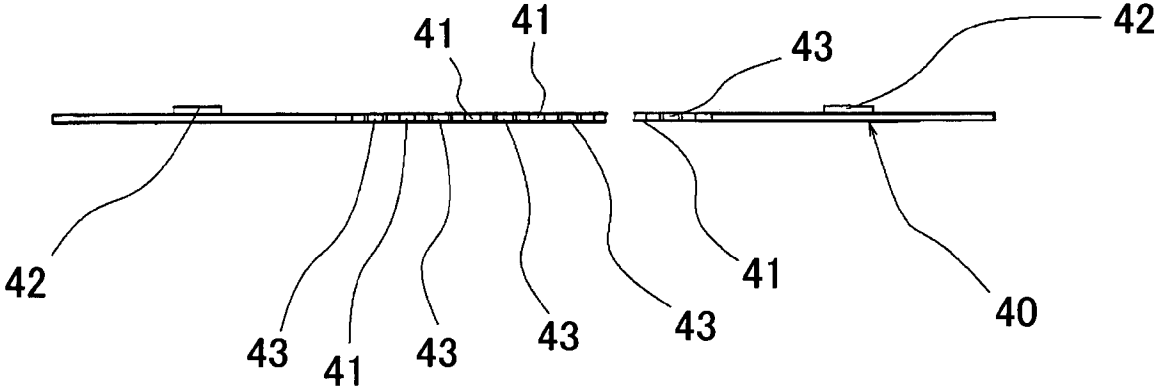
FIG. 12B is a side view of the ground terminal 40.

Now, a configuration of the ground terminal 40 will be described in reference to FIGS. 12A and 12B. FIG. 12A is a front view of the ground terminal 40. FIG. 12B is a side view of the ground terminal 40.

The ground terminal 40 is composed of a thin plate made of a metal having an electrically conducting property, and has ground-terminal-holding protrusions 42 respectively provided in two end portions thereof in its longitudinal direction; the protrusions 42 serve to hold the ground terminal 40 in the ground-terminal-receptacle hole 15 after the ground terminal 40 is forced into the hole 15. The ground-terminal-holding protrusions 42 make the thickness of the ground terminal 40 larger than the width of the ground-terminal-receptacle hole 23. As a result, when the ground terminal 40 is inserted into the ground-terminal-receptacle hole 23, the ground terminal 40 is to be forced into the hole 23 and thus held therein. The ground terminal 40, which can be forced into the hole and held therein in this way, can avoid falling out of the second housing part 20 accidentally.

Further, between the ground-terminal-holding protrusions 42, there are alternately disposed the above-described outline-keeping comb tooth-like members 41 for keeping the outline of a coaxial cable 50 and clearance-keeping comb tooth-like members 43 for keeping the clearance between the clipping pieces 3, 4. FIG. 7 shows the condition where each coaxial cable 50 is held between the outline-keeping comb tooth-like members 41 from outside the outer insulating layer 54, i.e. a portion of the cable with the largest diameter, while the clipping pieces 3, 4 is held so that the distance therebetween is not narrowed to a distance smaller than a predetermined one. In addition, a coaxial cable 50 is held at three points (from outside the outer insulating layer 54) by two outline-keeping comb tooth-like members 41 and one clearance-keeping comb tooth-like member 43 for keeping the clearance between the clipping pieces 3, 4 and as such, the risk such that displacement of a coaxial cable 50 may cause the piercing terminal 1 to come into contact with the core conductor wire 51 of the cable can be avoided.

Moreover, between the outline-keeping comb tooth-like members 41 is formed one clearance-keeping comb tooth-like member 43, which has a length shorter than that of the outline-keeping members 41 and serves to force down a coaxial cable 50 from outside the outer insulating layer 54, i.e. a portion of the cable with the largest diameter. The clearance-keeping comb tooth-like member 43 also serves to prevent the displacement of each coaxial cable.

Second Housing Part

Figure 13:
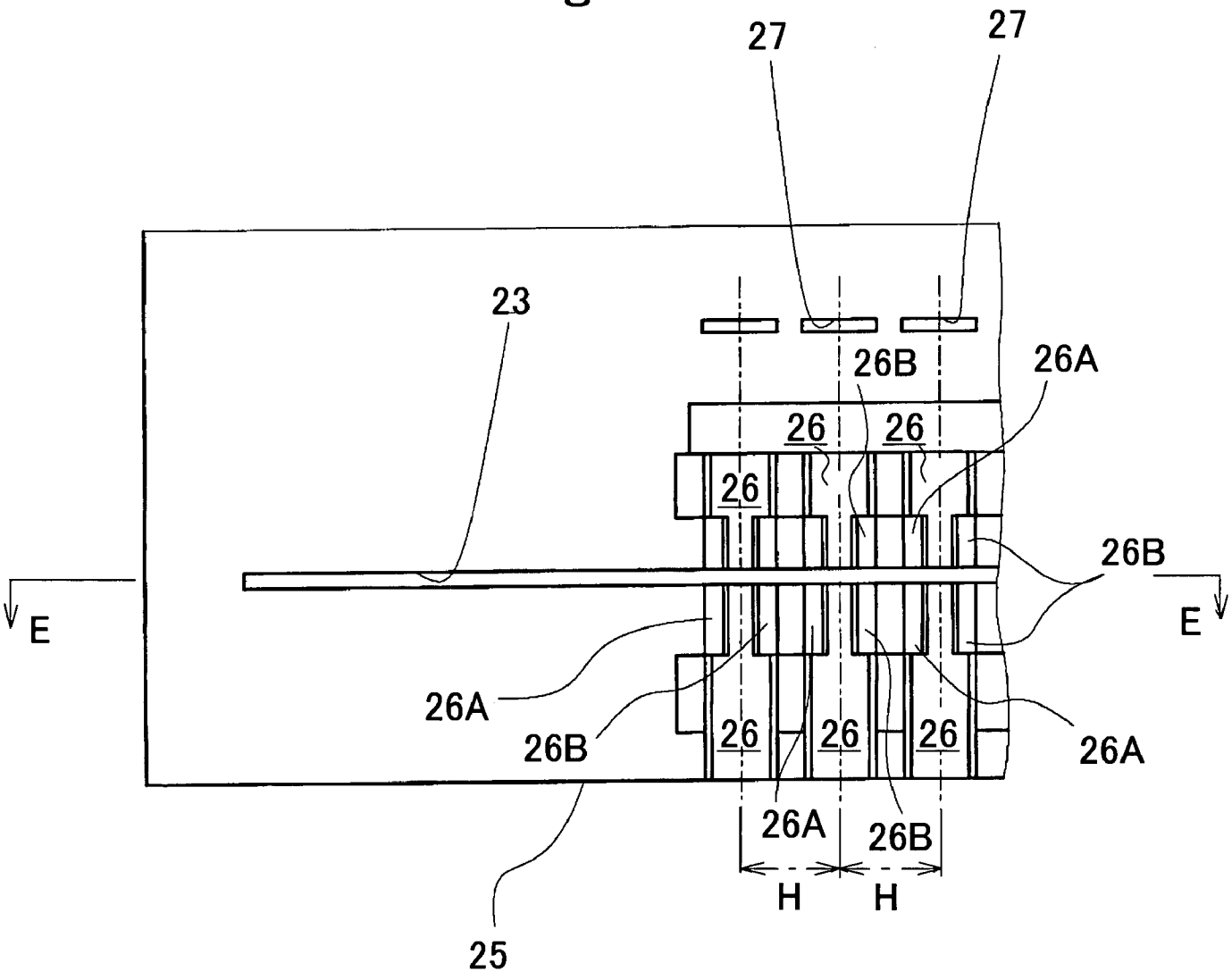
FIG. 13 is a bottom view of the second housing part.
Figure 14:
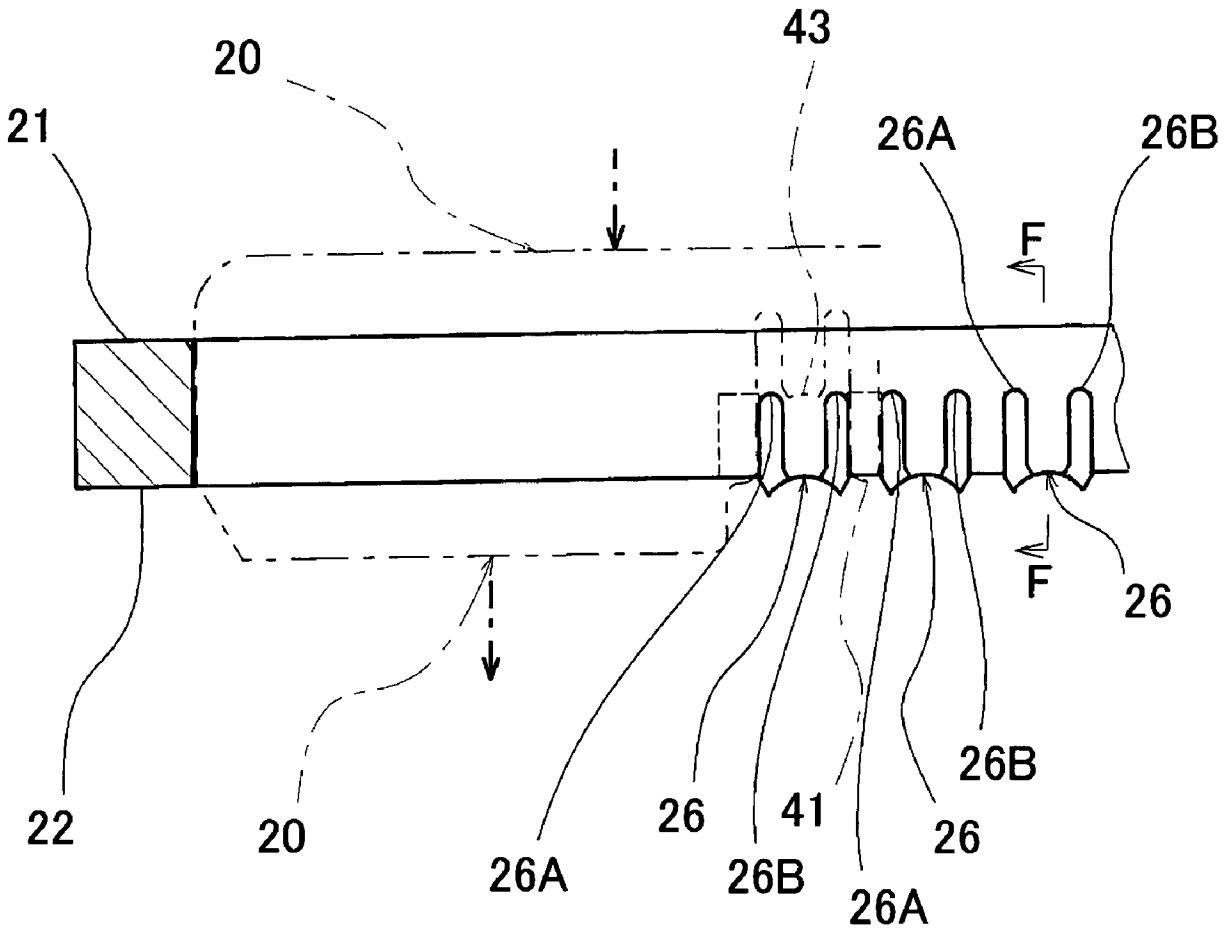
FIG. 14 is a sectional view of the second housing part taken along the line E—E in FIG. 13.
Figure 15:
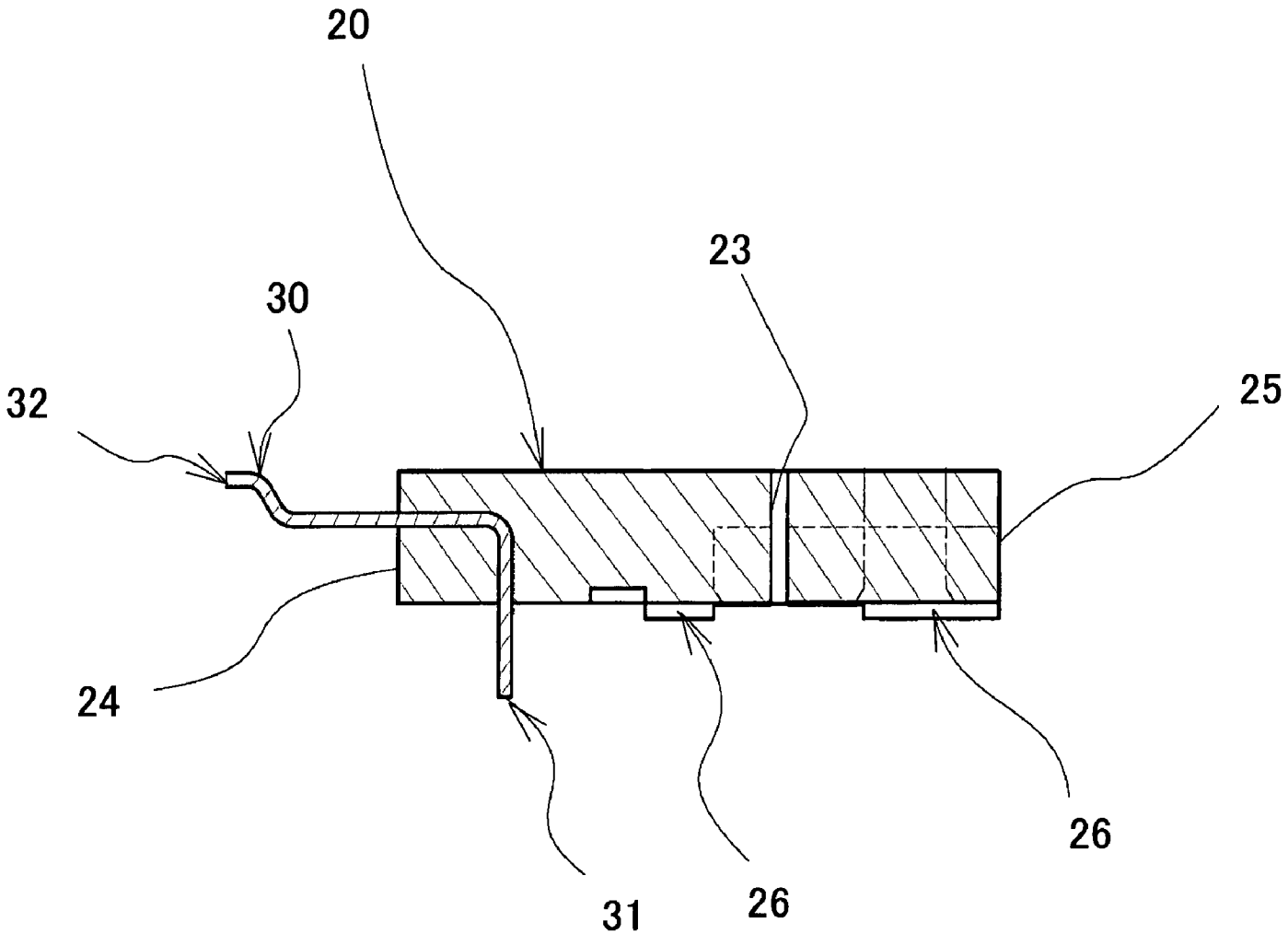
FIG. 15 is a sectional view of the second housing part taken along the line F—F in FIG. 14.

A structure of the second housing part will be described in reference to FIGS. 13–15. FIG. 13 is a bottom view of the second housing part. FIG. 14 is a sectional view of the second housing part taken along the line E—E in FIG. 13. FIG. 15 is a sectional view of the second housing part taken along the line F—F in FIG. 14.

The second housing part 20 is composed of an insulative material made by molding of a resin, etc. In the second housing part 20, the press-connecting contact 30 shaped into a thin rod form is fixed so that its first end 31 is lead out from the bottom surface 22 of the second housing part and the second end 32 is led out from a first side 24 of the second housing part 20. The first end 31 of the press-connecting contact 30 is electrically connected to the core conductor wire 51 of a coaxial cable 50, and the second end 32 is electrically connected to a wired circuit on an outer circuit board by soldering or connection under pressure. In other words, the press-connecting contact 30 is provided in the second housing part 20, protruding in a direction in parallel with the direction in which the first and second housing parts 10, 20 are combined up and down and opposite to the direction in which the piercing terminal 1 is embedded. Further, a U-shaped leading end portion of the press-connecting contact 30, especially a press-connecting blade 32, i.e. the first end 32, tears a hole in the inner insulating layer 52 and is electrically connected to the core conductor wire 51.

Further, the second housing part 20 has a second side 25 opposite to the first side 24 from which the press-connecting contact 30 is led out; a guide groove 26 which extends from a second side 25 thereof inwardly and is capable of placing a coaxial cable 50 thereon is provided on the second housing part 20.

In locations in the bottom surface 22 of the second housing part 20 opposited to the location of each horseshoe-shaped piercing terminal-receptacle hole 13 in an up and down direction when the first and second housing parts 10, 20 are assembled up and down, there is formed a pair of grooves 26A, 26B into which paired clipping pieces 3, 4 of each piercing terminal 1 are inserted.

In a location in the second housing part 20 near to the first side 24 on a prolongation of a straight line segment along which the guide groove 26 extends and opposite to the location of each contact-receptacle hole 14 in an up and down direction, an opening 27 for leading out the first end 31 of each press-connecting contact 30 is formed.

Press-Connecting Contact

Figure 16A:
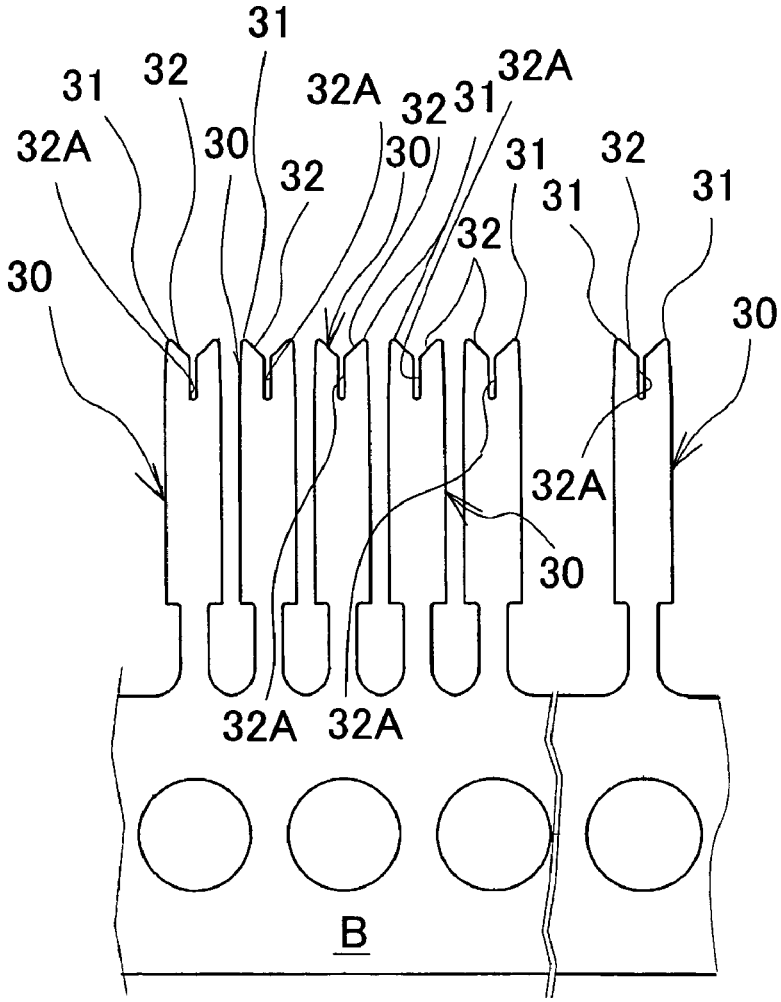
FIG. 16A is a front view showing the condition where a plurality of press-connecting contacts 30 are coupled to a common member B.
Figure 16B:
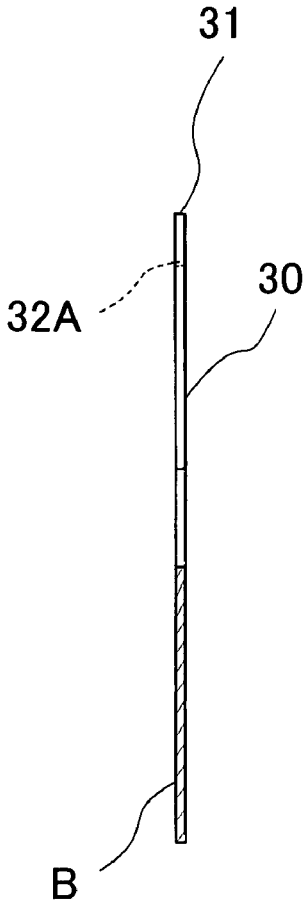
FIG. 16B is a side view showing the condition illustrated by FIG. 16A.

A structure of the press-connecting contact 30 will be described in reference to FIGS. 16A and 16B. FIG. 16A is a front view showing the condition where a plurality of press-connecting contacts 30 are coupled to a common member B. FIG. 16B is a side view showing the condition illustrated by FIG. 16A.

Each press-connecting contact 30 has a press-connecting blade 32 formed in a U-like form in front view in a first end 31 of the contact; the press-connecting blade 32 serves to tear a hole in the inner insulating layer 52 of a coaxial cable 50 thereby to electrically connect the press-connecting contact 30 to the core conductor wire 51 of the coaxial cable 50 when the coaxial cable 50 is pressed against the inner insulating layer 52. In a central portion of the press-connecting blade 32 is formed a press-connecting groove 32A for leading and fixing the core conductor wire 51, the width of which becomes gradually narrower from two apexes of the first end 31 toward the center thereof. Also, the press-connecting groove 32A is arranged to have a width somewhat smaller than an outer diameter r1 of the core conductor wire 51 in order to maintain a good condition for electrical connection with the core conductor wire 51.

The press-connecting contacts 30 are individually separated from the common member B to which they are coupled in the form of a hoop, and when the second housing part 20 is molded, each the press-connecting contact 30 is partially sealed in the second housing part 20.

Figure 17:
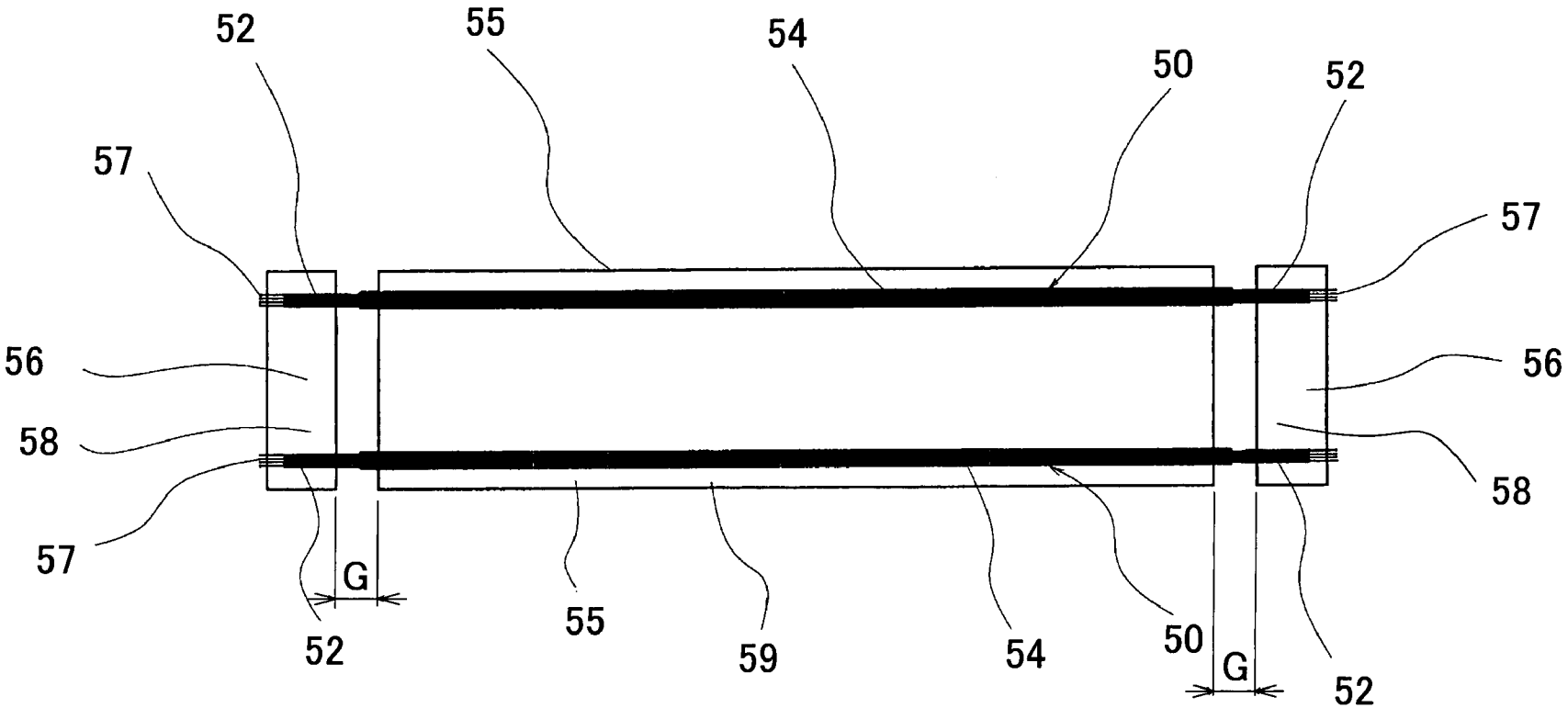
FIG. 17 is a plane view showing the condition where a plurality of coaxial cables are bundled at predetermined intervals H into a harness form by a laminating process.

Connection between Piercing Terminal and Coaxial Cable and its Effect and Advantage The structures of the piercing terminal 1, first and second housing parts 10, 20, ground terminal 40, and press-connecting contact 30 have been described above in reference to FIGS. 1–16B. Now, the connection between each piercing terminal 1 and a coaxial cable for providing a plurality of coaxial cable 50 as illustrated in FIG. 17 on the housing (in the condition where the first housing part 10 and second housing part 20 are assembled up and down) all at once will be described in more detail below. FIG. 17 is a plane view showing a plurality of coaxial cables 50 which have been laminated with a resin sheet, wherein the so grouped coaxial cables 50 are bundled into a wire harness form at predetermined intervals H.

First, a plurality of coaxial cables 50 are disposed at the predetermined intervals H. Then, a resin sheet 59 is laminated to the central portion 55 of the plurality of coaxial cables 50 from above the outer insulating layers 54 of the coaxial cables to bundle into a group of coaxial cables. Further, in two end portions 56 of the group of coaxial cables 50, which are spaced away from two ends of the central portion 55 by a predetermined distance G respectively, another resin sheet 58 holds the group of coaxial cables 50 in the condition where two leading end portions 57 of each coaxial cable 50 are bared so that the inner insulating layer 52 of a thin wire portion of each coaxial cable 50 is exposed to the outside.

In other words, a group of coaxial cables 50 are processed as follows. First, in two leading end portions 57 of each coaxial cable, the outer insulating layer 54 and outer conductor-shielding layer 53 are removed thereby to bare the inner insulating layer 52. Then, the central portion 55 of the group of the coaxial cables 50 is laminated with the resin sheet 59, whereas the two end portions 56, each partially including the leading end portions 57 of grouped coaxial cables, are laminated with the resin sheet 58 different from the resin sheet 59, provided that the central portion 55 and each of the two end portions 56 are spaced away from each other by a distance G larger than the distance F between the piercing terminal 1 and press-connecting contact 30, to which coaxial cables 50 are to be press-connected. The reasons why such distance F is ensured in this embodiment are as follows. The first is piercing terminals 1 and press-connecting contacts 30 are made of a thin metallic plate whenever possible thereby to narrow a pitch H between coaxial cables when the coaxial cables are bundled into a wire harness form and as such, it is required to reduce the risk that piercing terminals 1 and press-connecting contacts 30 are deformed by stabbing forces produced when the piercing terminals 1 and press-connecting contacts 30 are stabbed into coaxial cables. The second is it is intended to enable the visual alignments with respect to each cable-receiving groove 16 of the first housing part 10 and each guide groove 26 of the second housing part 20 to be performed easily.

Then, the grouped coaxial cables 50 illustrated by FIG. 17 are disposed in the cable-receiving grooves 16 of the first housing part 10. After that, the second housing part 20 is pressed against the first housing part 10 from above in order to force the bared inner insulating layer 52 of each coaxial cable 50 into the press-connecting groove 32A of the corresponding press-connecting contact 30 which is integrally fixed to the second housing part 20 and electrically connect the press-connecting contact 30 to the core conductor wire 51 of the coaxial cable 50.

Next, piercing terminals 1 are forced into the horseshoe-shaped terminal-receptacle holes 13 from below the first housing part 10, while the ground terminal 40 is forced into the ground-terminal-receptacle hole 15 from above.

As described above, each piercing terminal 1 includes a pair of opposed clipping pieces 3, 4 which are arranged in parallel and spaced from each other by a small distance larger than the outer diameter r1 of the core conductor wire 51 and smaller than the outer diameter R2 of the inner insulating layer 52. Each piercing terminal 1 further includes: piercing blades 3A, 4A formed by chamfering leading ends of the clipping pieces 3, 4 into tapers; a pair of curved portions 3B, 4B interposed in the respective clipping pieces 3, 4, each of which is shaped into an outwardly convex form extending across the width of the respective clipping pieces 3, 4; a pair of reinforcing ribs 3C shaped into an outwardly-convex form, arrayed in two rows in parallel in a direction of the width of the clipping piece 3, and extending from the curved portion 3B toward the leading and rear ends of the clipping piece 3 with the curved portion 3B interposed between the reinforcing ribs 3C in each row; and a pair of reinforcing ribs 4C shaped into an outwardly-convex form, arrayed in two rows in parallel in a direction of the width of the clipping piece 4, and extending from the curved portion 4B toward the leading and rear ends of the clipping piece 4 with the curved portion 4B interposed between the reinforcing ribs 4C in each row. The portions between reinforcing ribs 3C and between reinforcing ribs 4C will serve as ground-terminal-receiving grooves 3D, 4D.

As described above, FIG. 4 shows the condition where the piercing terminal 1 and the ground terminal 40 have been forced into the housing. When a coaxial cable 50 is put between the first and second housing parts 10, 20 and then the piercing terminal 1 is forced into the first housing part 10 from below, the piercing blades 3A, 4A of the paired clipping pieces 3, 4 tear holes in the outer insulating layer 54 and outer conductor-shielding layer 53 of the coaxial cable 50, brush against the periphery of the inner insulating layer 52, again tear holes in the outer conductor-shielding layer 53 and outer insulating layer 54 in this order, and protrude from the coaxial cable outwardly under the pressing force produced by inserting the piercing terminal 1. During this step, the reinforcing function of the reinforcing ribs 3C, 4C prevents the clearance between clipping pieces 3, 4 from outwardly widening, and the inward reduction of the distance is prevented by making the clipping pieces 3, 4 pinch and hold a protruding portion 43, i.e. a clearance-keeping comb tooth-like member, of the ground terminal 40 forced into the housing from above. Therefore, the protruding portion 43, which is a comb tooth-like member for keeping the distance, is arranged to have a width substantially equal to the clearance between the clipping pieces 3, 4.

The distance h between the clipping pieces 3, 4 is larger than the outer diameter r1 of the core conductor wire 51 and smaller than the outer diameter R2 of the inner insulating layer 52, more specifically the distance h is somewhat smaller than the outer diameter R2 of the inner insulating layer 52. Hence, the clipping pieces 3, 4 can slide between the periphery of the inner insulating layer 52 and the outer conductor-shielding layer 53 while brushing against the periphery of the inner insulating layer 52 and then protrude from the coaxial cable outwardly. This makes it possible to avoid the risk that the clipping pieces 3, 4 may short-circuit with the core conductor wire 51.

Further, in the condition where the piercing terminal 1 is press-connected to a coaxial cable 50, the curved portions 3B, 4B are located on the periphery the coaxial cable 50 pinched and hold between the clipping pieces 3, 4, and the center of curvature of the inner diameter of each of the curved portions 3B, 4B shaped into arcs substantially coincides with the center of the coaxial cable 50, and therefore the distance between the outer conductor-shielding layer 53 and core conductor wire 51 of the coaxial cable 50 can be kept substantially constant in a portion of the coaxial cable 50 pinched and held by the clipping pieces 3, 4 as well as in the other portion of the cable. Thus, it becomes possible to minimize changes of impedance between the outer conductor-shielding layer 53 and core conductor wire 51.

In addition, the curved portions 3B, 4B of the pair of opposed clipping pieces 3, 4 are provided so as to lie on the same virtual circle and the outer diameter of the curved portions 3B, 4B located on the same virtual circle substantially coincides in size with the inner diameter of the outer conductor-shielding layer 53 taking the form of a tube in section. Accordingly, it can be expected as an advantage that an area for electrical connection between the outer periphery portions of the curved portions 3B, 4B and inner portions lying on a circle formed by the inner diameter of the outer conductor-shielding layer 53 can be ensured sufficiently.

Further, in the case where the first housing part 10 and second housing part 20 are combined with each other up and down, the clearance-keeping comb tooth-like member 43 is disposed between the clipping pieces 3, 4 and the comb tooth-like members 41 for keeping the outline of a coaxial cable 50 are disposed outside the clipping pieces 3, 4. This can avoid the risk that when the piercing blades 3A, 4A of the clipping pieces 3, 4 tear holes in outer insulating layer 54, the tearing stress produced by tearing holes in the outer insulating layer 54 may cause deformation of the clipping pieces 3, 4 thereby to widen or narrow the clearance between them.

[Second Embodiment]

The second embodiment as a modification of the first embodiment will be described in reference to FIGS. 18–22. In the second embodiment, the first housing part 10 and second housing part 20 illustrated in the first embodiment are integrated into a male connector. The second embodiment is arranged so that electronic connection can be established disengagably by engaging the male connector with a female connector previously mounted on a main circuit board by soldering.

Figure 18:
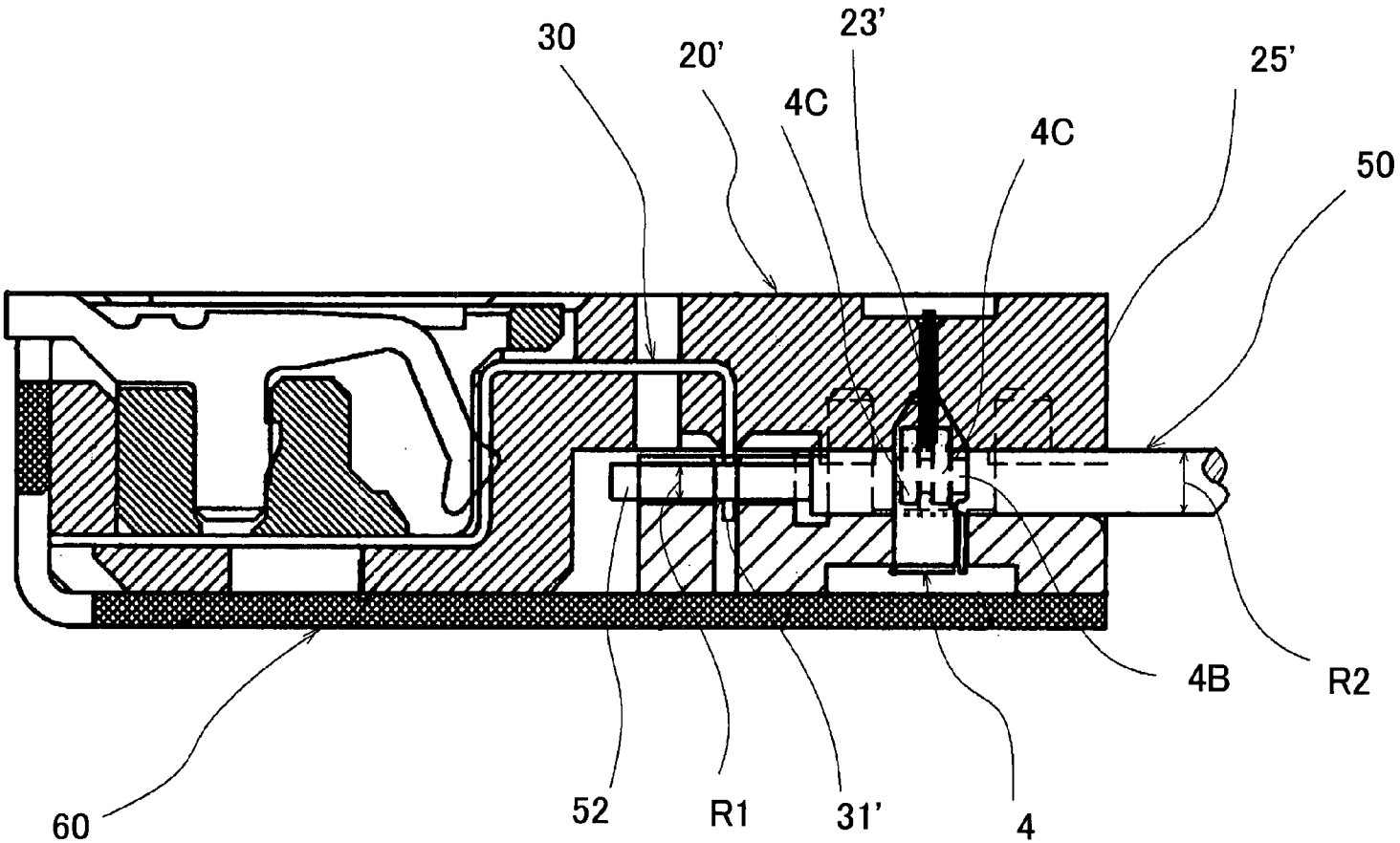
FIG. 18 is a side, longitudinal sectional view showing the condition where a housing composed of the first housing part 10' and second housing part 20' with the piercing terminal 1, press-connecting contact 30, ground terminal 40, and a coaxial cable 50 incorporated therein has been sealed by an outline-keeping shell 60 according to a second embodiment of the invention.

In FIGS. 18–22, like parts in the several drawings are identified by the same reference character, thereby to omit the repeated description about them. In addition, parts of similar arrangement are identified by the same reference character accompanied with a mark of single quote. For instance, the first housing part 10' and second housing part 20' in FIG. 18 are somewhat different from the parts marked with 10 and 20 in form, but they are identical in function. FIG. 18 is a side, longitudinal sectional view showing the condition where a housing composed of the first housing part 10' and second housing part 20' with the piercing terminal 1, press-connecting contact 30, ground terminal 40, and a coaxial cable 50 incorporated therein has been sealed by an outline-keeping shell 60. FIG. 19A is a plane view showing the condition illustrated by FIG. 18. FIG. 19B is a side view showing the condition illustrated by FIG. 18. FIG. 20A is a plane view of a female connector 70. FIG. 20B is a front view of the female connector 70. FIG. 20C is a side view of the female connector 70.

The grounding path of the outer conductor-shielding layer 53 of the coaxial cable 50 is formed by the following steps. First, the piercing terminal 1 is connected to the outer conductor-shielding layer 53 of the coaxial cable 50. Then, when the outline-keeping comb tooth-like members 41 of the ground terminal 40 are press-inserted along the ground-terminal-receiving grooves 3D, 4D formed between paired reinforcing ribs 3C of the piercing terminal 1 and between paired reinforcing ribs 4C thereof, the outline-keeping comb tooth-like members 41 inwardly tear holes in the outer insulating layer 54 of the coaxial cable 50, which is located radially outside the ground-terminal-receiving grooves 3D, 4D, and are press-connected to the outer conductor-shielding layer 53. Further, the ground terminal 40 is connected to the outline-keeping shell 60 formed from a conductive metallic plate. The resultant male connector may be connected to a female connector 70 previously mounted on the main circuit board by soldering.

Next, a press-connecting method in the second embodiment will be described in reference to FIGS. 22A–22H.

Figure 22A:
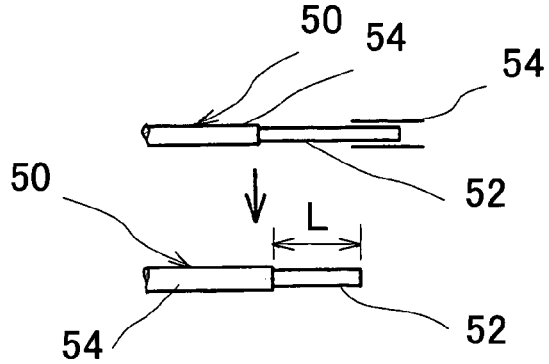
FIGS. 22A–22H are illustrations of assistance in explaining a press-connecting method according to the second embodiment.

First, in the step illustrated by FIG. 22A, a coaxial cable 50 is subjected to a pretreatment such that the outer conductor-shielding layer 53 and outer insulating layer 54 are stripped from the coaxial cable 50 up to a length of L from one end of the cable along its length to bare the inner insulating layer 52. As a result, the coaxial cable 50 is made one with a shoulder, which has a diameter of R1 in the range up to the length L from the end along its length and has another diameter R2 larger than R1 in the remaining range.

Figure 22B:
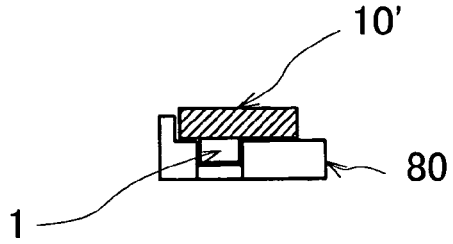

In the step illustrated by FIG. 22B, the first housing part 10' with a horseshoe-shaped piercing terminal-receptacle hole 13 for each piercing terminal 1 facing down is placed on a top surface of a jig 80.

Figure 22C:
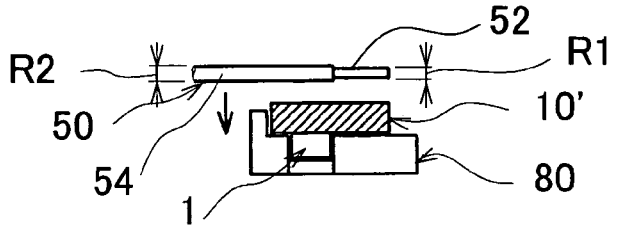

In the step illustrated by FIG. 22C, portions having the diameters R1 and R2 of the coaxial cable 50 already processed as illustrated in FIG. 22A are placed from above in the grooves 16A and 16B provided in the first housing parts 10' respectively, while the first housing part 10' is left on the jig 80.

Figure 22D:
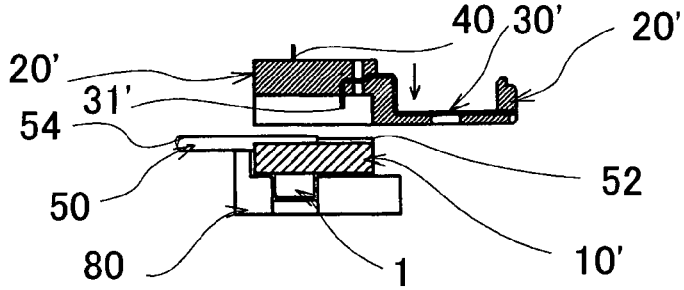

In the step illustrated by FIG. 22D, the coaxial cable 50 is put in place on the first housing part 10', and then the second housing part 20' is placed on the first housing part 10' from above. When the second housing part 20' is assembled to the first housing part 10' from above, a U-shaped press-connecting blade 32 of the press-connecting contact 30 tears a hole in the inner insulating layer 52 thereby to be press-connected to the core conductor wire 51.

Figure 22E:
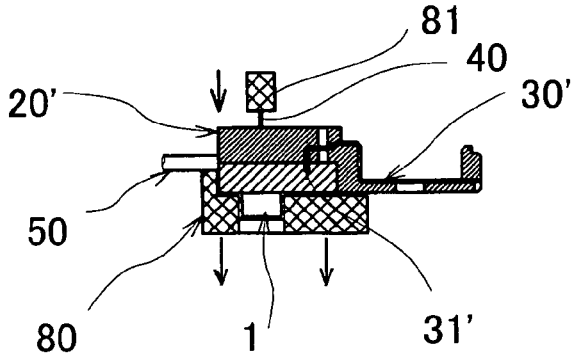

In the step illustrated by FIG. 22E, in the condition where the second housing part 20' has been placed on the first housing part 10' from above, the piercing terminal 1 is inserted in the first housing part 10', forced to tear a hole in the outer insulating layer 54 of the coaxial cable 50, and then press-connected to the outer conductor-shielding layer 53. After the press-connecting process of the piercing terminal 1 to the coaxial cable 50 has been completed, a ground terminal 40 is forced into a ground-terminal-receptacle hole 23 in the second housing part 20' by a jig 81 for press-insertion toward a direction indicated by the arrow in the drawing from above. As a result, the ground terminal 40 is directly press-connected to the outer conductor-shielding layer 53, and the press-connected portions of the outer conductor-shielding layer 53 are sandwiched by the ground terminal 40 and piercing terminal 1. The above-described press-connecting method enables retaining tighter electrical contact in comparison with the case where the outer conductor-shielding layer 53 isn't sandwiched by the ground terminal 40 and piercing terminal 1. In other words, a coaxial cable 50 has an inner insulating layer 52 for covering its core conductor wire 51 and as such, the elasticity of the inner insulating layer 52 may prevent the coaxial cable 50 from being held tightly when the coaxial cable 50 is sandwiched and held form outside; however when the outer conductor-shielding layer 53 is sandwiched and held between the ground terminal 40 and piercing terminal 1, the coaxial cable 50 can be held tightly.

Figure 22F:
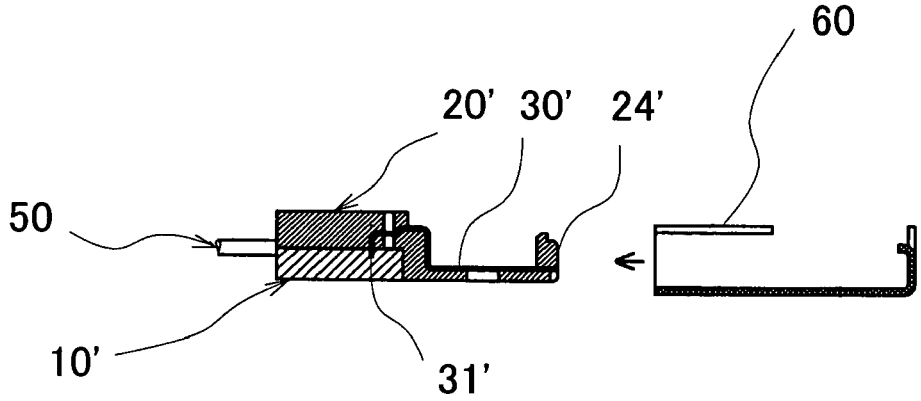

In the step illustrated by FIG. 22F, under the situation where the coaxial cable 50 is sandwiched and held between the first and second housing parts 10' and 20' and the piercing terminal 1 and press-connecting contact 30 are press-connected to the coaxial cable 50, the outline-keeping shell 60 is fit on a housing composed of the first and second housing parts from the first side 24 of the housing and then the housing is housed in the outline-keeping shell 60.

Figure 22G:
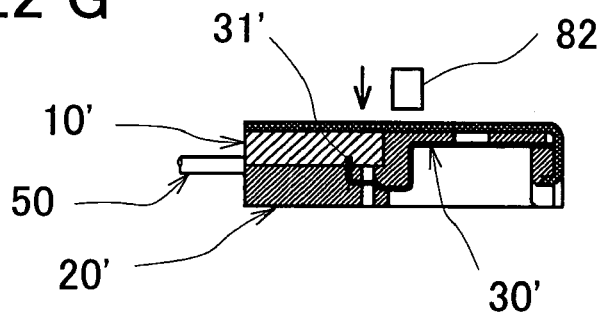
Figure 22H:
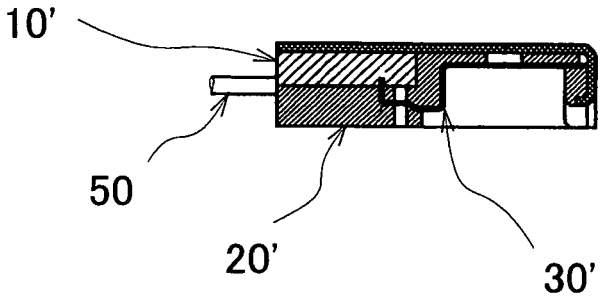
Figure 23:
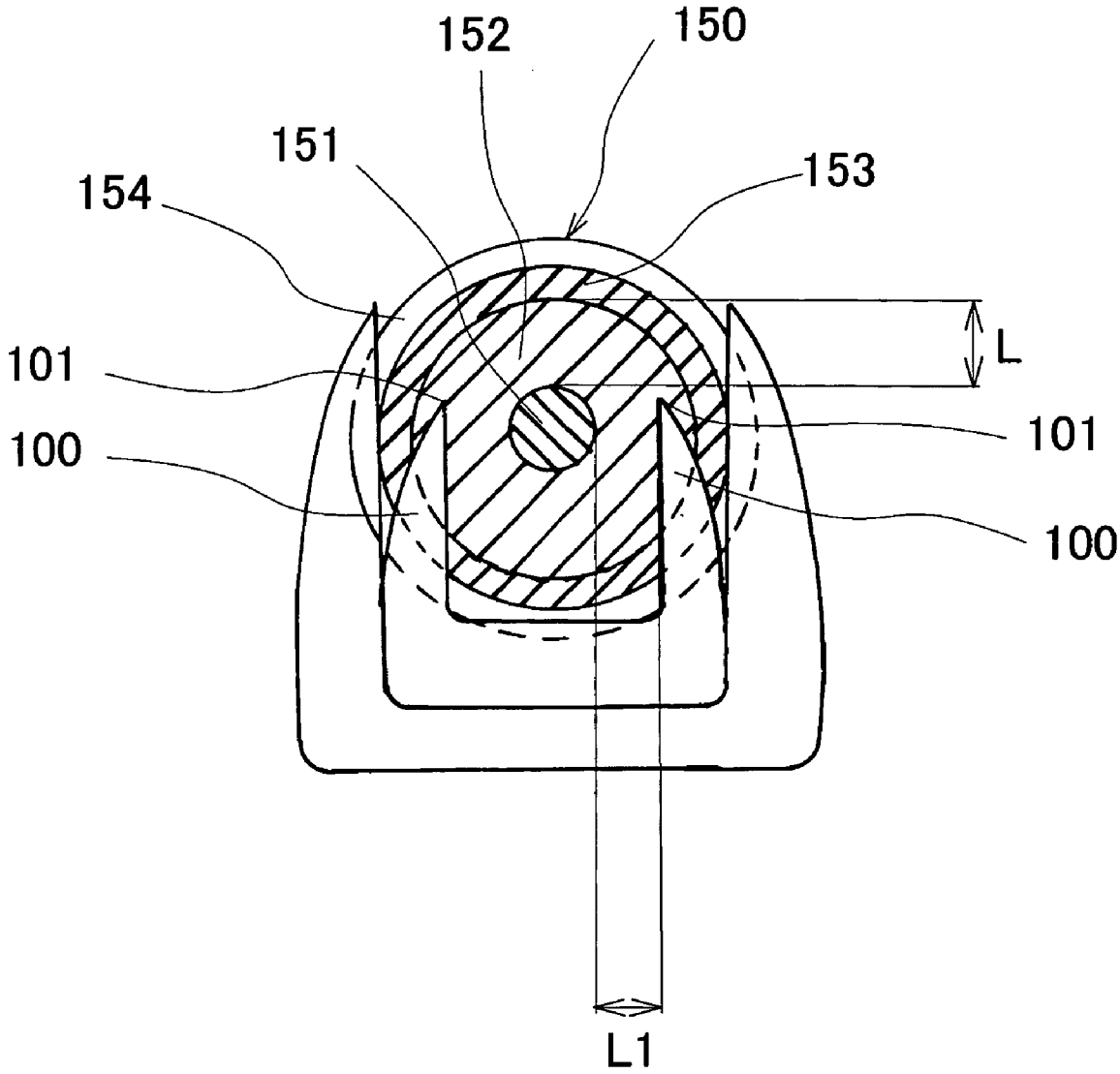
FIG. 23 is an illustration of assistance in explaining JP-A-2001-223039.
Figure 24:
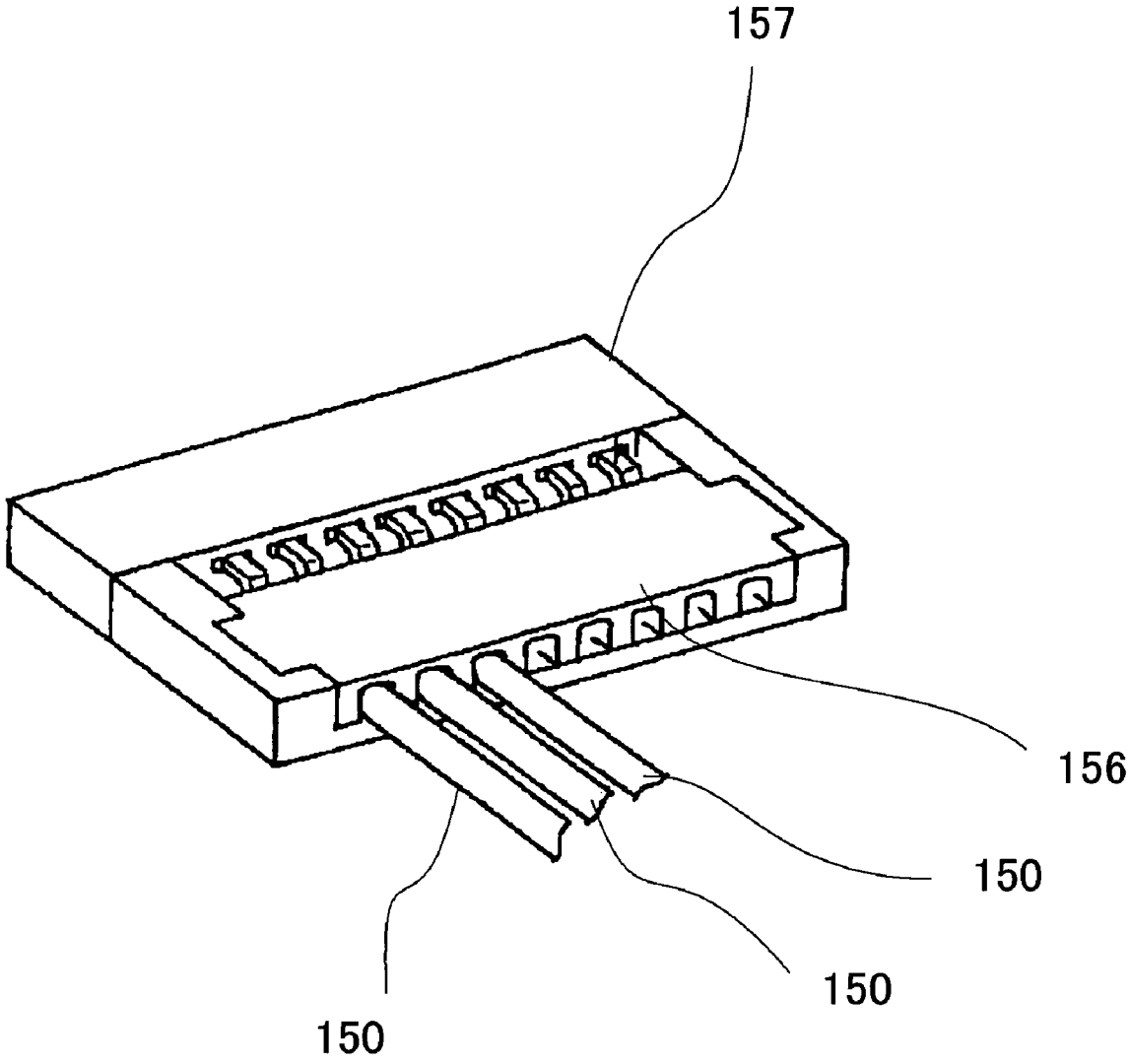
FIG. 24 is an illustration of assistance in explaining JP-A-2001-223039.
Figure 25:
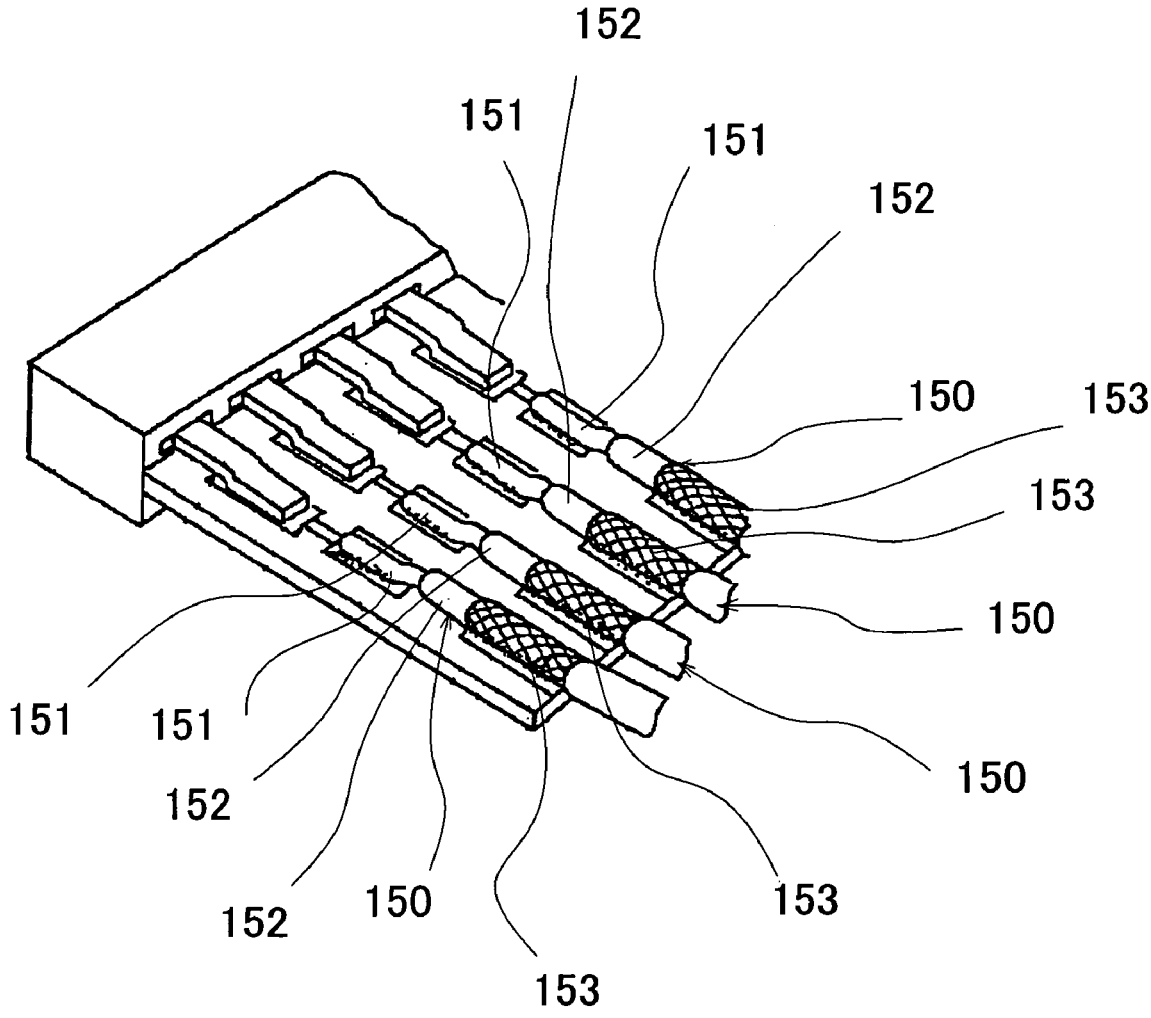
FIG. 25 is an illustration of assistance in explaining JP-A-2001-223039.

In the step illustrated by FIG. 22G, the housing is turned upside down, and then the outline-keeping shell 60 is press-fitted on the housing from above in the direction indicated by the arrow in the drawing by a press-fitting jig 82 for shell. The forementioned male connector as illustrated by FIG. 22H is thus completed.

Figure 20A:
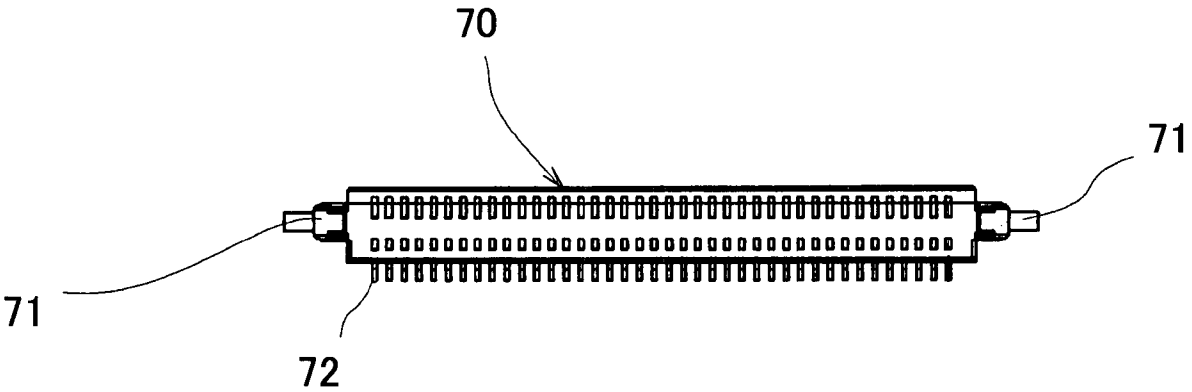
FIG. 20A is a plane view of a female connector 70.

The male connector is connected to a female connector as illustrated by FIG. 20A for use. The female connector has a reinforcing metal attachment 71 to be electrically connected to the ground terminal 40, and a plurality of gulwing-shaped terminals 72 to be electrically connected to the press-connecting contact 30 and mounted on the main circuit board by soldering.

Figure 19A:
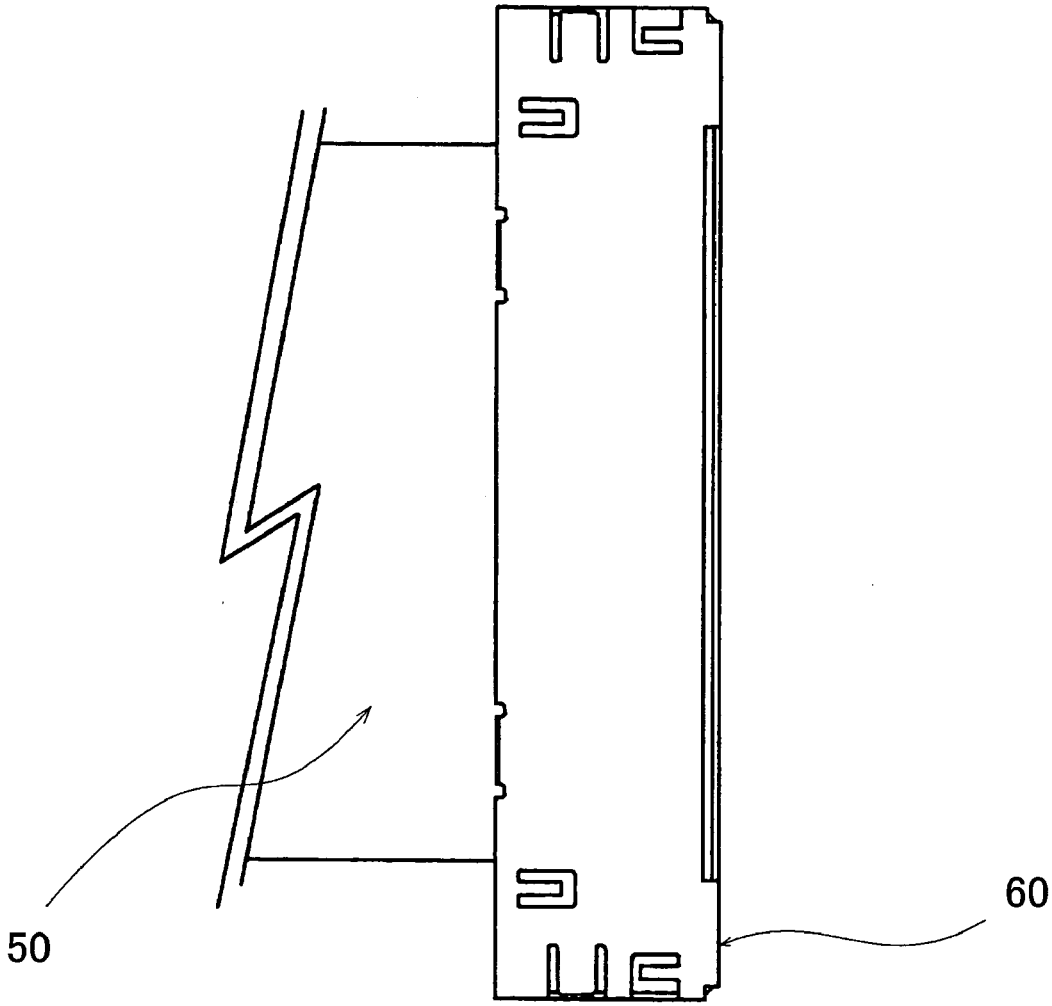
FIG. 19A is a plane view showing the condition illustrated by FIG. 18.
Figure 19B:
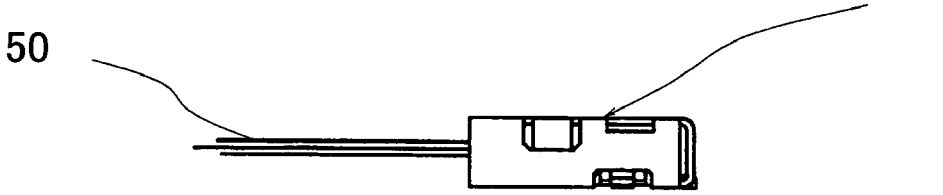
FIG. 19B is a side view showing the condition illustrated by FIG. 18.
Figure 20B:
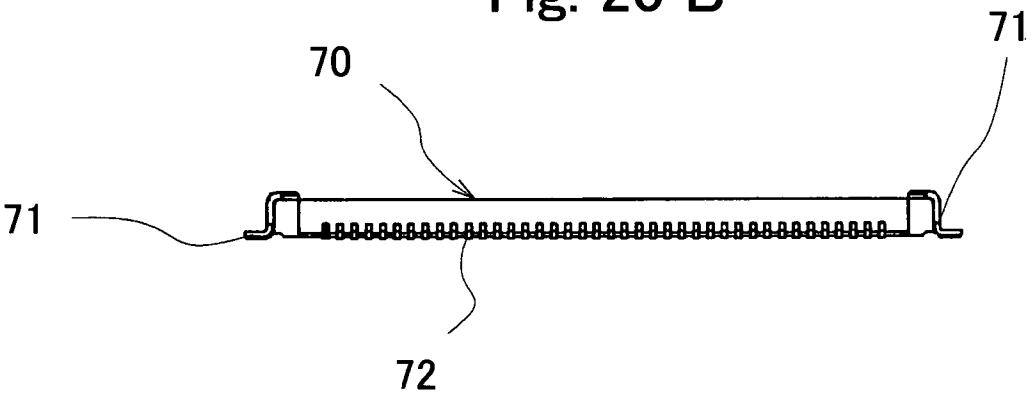
FIG. 20B is a front view of the female connector 70.
Figure 20C:
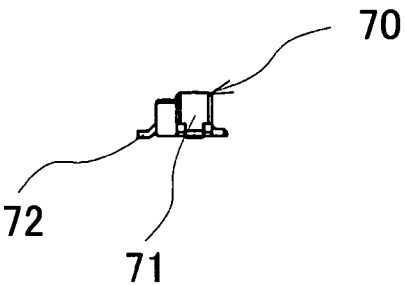
FIG. 20C is a side view of the female connector 70.
Figure 21C:
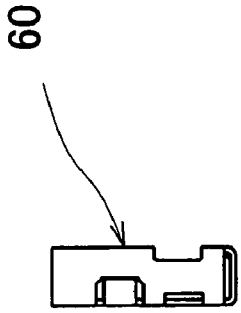
FIG. 21C is a rear view of the connector structure shown in FIG. 18.
Figure 21A:
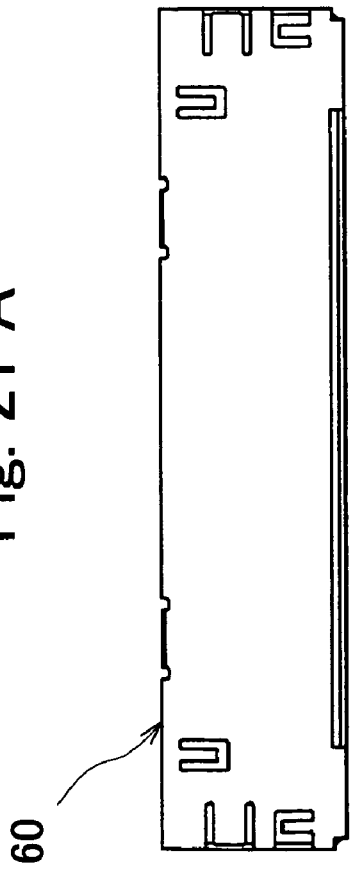
FIG. 21A is a plane view of the connector structure shown in FIG. 18, wherein coaxial cables are omitted.
Figure 21B:
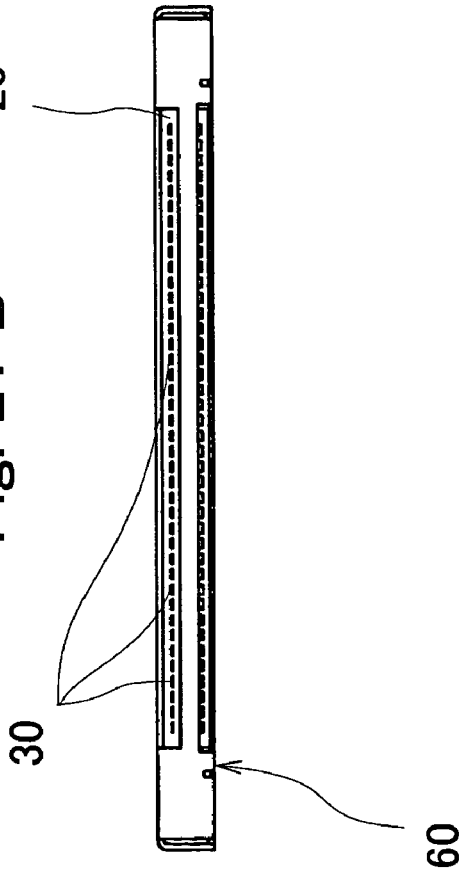
FIG. 21B is a side view of the connector structure shown in FIG. 18.

Referring now to FIGS. 19A and 19B, there is shown a female connector finished by the steps illustrated by FIGS. 22A–22H. FIGS. 20A–20C show the male connector, wherein a coaxial cable is omitted.

The invention can provide a pressure connection structure for coaxial cables, in which coaxial cables are bundled in the form of a cable harness, thereby enabling high-density simple pressure connection. In addition, the pressure connection structure for coaxial cables is especially suitable for application to coaxial cables having a diameter of 0.5 mm or smaller. The structure makes it possible to utilize coaxial cables at a high density as electricity transmitting cables for a unit to be operated such as an LCD screen instead of conventional flexible cables. In addition, the pressure connection structure of the invention is arranged so that even when a piercing terminal for a coaxial cable is connected to an outer conductor-shielding layer of the coaxial cable, the impedance between the core conductor wire and outer conductor-shielding layer doesn't vary between an electrically-connecting portion involved in electrical connection of the piercing terminal to the coaxial cable and other portions of the coaxial cable. Since impedance changes can be reduced in an electrically-connecting portion involved in electrical connection of a piercing terminal to the coaxial cable in comparison with other portions of the coaxial cable like this, the application of the pressure connection structure of the invention to a connector for electrical connection, which has been increasingly reducing in pitch size in recent years, makes it possible to avoid impedance changes caused by a connector for electrical connection in a related electrical circuit.

What is claimed is:

1. A pressure connection structure for coaxial cables, comprising:

a first housing part, which is provided with a plurality of receptacle holes being aligned in a line with predetermined interval distances, in which a plurality of piercing terminals are inserted, respectively, each of the said plurality of piercing terminals including a pair of clipping pieces being composed of conductive metal thin plates, each of the pair of clipping pieces being provided with a piercing blade at a leading end thereof such that the piercing blade of each of the pair of clipping pieces of the piercing terminal points to outside of each of the receptacle holes; and a second housing part, which holds a plurality of press-connecting contacts being provided with U-shaped leading end portions, respectively, as the U-shaped leading end portions project in an opposite direction to the piercing blade pointing direction, wherein said first housing part and said second housing part approach each other in the piercing blade pointing direction and in the U-shaped leading end portion projecting direction, respectively, and engage such that the piercing blade and the corresponding press-connecting contact are offset in an axial direction of the corresponding coaxial cable;

wherein said first housing part and said second housing part are provided with the corresponding number of said piercing terminals and said press-connecting contacts, respectively; and wherein: each of the coaxial cables comprises a core conductor wire, an inner insulating layer for covering the core conductor wire, an outer conductor-shielding layer for covering the inner insulating layer, and an outer insulating layer for covering the outer conductor-shielding layer; a distal end portion of each of the coaxial cables is processed such that the outer conductor-shielding layer and the outer insulating layer are removed such that the inner insulating layer is exposed; and the coaxial cables are aligned in a substantially parallel manner to the distal ends of the coaxial cables and disposed in a substantially plain manner between said first housing part and said second housing part such that the coaxial cables are pressed with a predetermined pressure such that each piercing terminal pierces the outer insulating layer of the corresponding coaxial cable to make an electrical connection to the outer conductor-shielding layer, and that each U-shaped leading end portion tears the inner insulating layer of the corresponding coaxial cable to make an electrical connection to the core conductor wire of the cable.

2. The pressure connection structure according to claim 1, wherein said plurality of coaxial cables are disposed in a common plane with predetermined intervals and laminated with a first resin sheet such that the distal end portions of the respective coaxial cables are laminated with a second resin sheet, the distal end portions being separated from the coaxial cables laminated with the first resin by a distance larger than a distance between each piercing terminal and the corresponding press-connecting contact.

3. The pressure connection structure according to claim 1, wherein each of said piercing terminals comprises a pair of clipping pieces, which are disposed substantially in parallel and in an opposing manner with a predetermined distance apart, the distance being larger than an outer diameter of the core conductor wire and smaller than an outer diameter of the inner insulating layer; a piercing blade formed by chamfering a leading end portion to make a taper toward the leading end of each of the pair of clipping pieces; a curved portion, which is curved outwardly with respect to the pair of clipping pieces; and a reinforcing rib extending from said curved portion toward the leading end and/or an opposing direction thereto on an outer surface thereof;

wherein said second housing part is provided with a pectinated flat-plate-shaped ground terminal of a conductive material having a first comb tooth-like member and a second comb tooth-like member for the corresponding piercing terminal, the first comb tooth-like member being shorter than the second comb tooth-like member, the ground terminal being disposed such that a distal end portion of the first comb tooth-like member is positioned between the corresponding pair of clipping pieces and a distal end portion of the second comb tooth-like member is positioned outside of the corresponding pair of clipping pieces when said first housing part and said second housing part engage.

4. The pressure connection structure according to claim 3, wherein said plurality of coaxial cables are disposed in a common plane with predetermined intervals and laminated with a first resin sheet such that the distal end portions of the respective coaxial cables are laminated with a second resin sheet, the distal end portions being separated from the coaxial cables laminated with the first resin by a distance larger than a distance between each piercing terminal and the corresponding press-connecting contact.

5. The pressure connection structure according to claim 3, wherein said reinforcing rib is paired with another reinforcing rib such that the two reinforcing ribs are aligned substantially in parallel and extending in a substantially same way of engagement direction of the first and second housing parts such that a recess between the two ribs is formed, in which the corresponding second comb tooth-like member is inserted.

6. The pressure connection structure according to claim 5, wherein said plurality of coaxial cables are disposed in a common plane with predetermined intervals and laminated with a first resin sheet such that the distal end portions of the respective coaxial cables are laminated with a second resin sheet, the distal end portions being separated from the coaxial cables laminated with the first resin by a distance larger than a distance between each piercing terminal and the corresponding press-connecting contact.

7. A connector for a plurality of coaxial cables, comprising:

a first housing part, which is provided with a plurality of receptacle holes being aligned in a line with predetermined interval distances, in which a plurality of piercing terminals are inserted, respectively, each of the said plurality of piercing terminals including a pair of clipping pieces being composed of conductive metal thin plates, each of the pair of clipping pieces being provided with a piercing blade at a leading end thereof such that the piercing blade of each of the pair of clipping pieces of the piercing terminal points to outside of each of the receptacle holes; and a second housing part, which holds a plurality of press-connecting contacts being provided with U-shaped leading end portions, respectively, as the U-shaped leading end portions project in an opposite direction to the piercing blade pointing direction, wherein said first housing part and said second housing part approach each other in the piercing blade pointing direction and in the U-shaped leading end portion projecting direction, respectively, and engage such that the piercing blade and the corresponding press-connecting contact are offset in an axial direction of the corresponding coaxial cable;

wherein said first housing part and said second housing part are provided with the corresponding number of said piercing terminals and said press-connecting contacts, respectively; and wherein: each of the coaxial cables comprises a core conductor wire, an inner insulating layer for covering the core conductor wire, an outer conductor-shielding layer for covering the inner insulating layer, and an outer insulating layer for covering the outer conductor-shielding layer; a distal end portion of each of the coaxial cables is processed such that the outer conductor-shielding layer and the outer insulating layer are removed such that the inner insulating layer is exposed; and the coaxial cables are aligned in a substantially parallel manner to the distal ends of the coaxial cables and disposed in a substantially plain manner between said first housing part and said second housing part such that the coaxial cables are pressed with a predetermined pressure such that each piercing terminal pierces the outer insulating layer of the corresponding coaxial cable around a portion thereof having not been processed for the exposure of the inner insulating layer to make an electrical connection to the outer conductor-shielding layer, and that each U-shaped leading end portion tears the inner insulating layer of the corresponding coaxial cable around a portion thereof having been processed for the exposure of the inner insulating layer to make an electrical connection to the core conductor wire of the cable.

* * * * *